US006876276B2

(12) United States Patent
Amano et al.

(10) Patent No.: US 6,876,276 B2
(45) Date of Patent: Apr. 5, 2005

(54) FILTER CIRCUIT AND HIGH FREQUENCY COMMUNICATION CIRCUIT USING THE SAME

(75) Inventors: Yoshihisa Amano, Nara (JP); Atsushi Yamada, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 2 days.

(21) Appl. No.: 10/312,836

(22) PCT Filed: Jun. 20, 2001

(86) PCT No.: PCT/JP01/05286

§ 371 (c)(1),
(2), (4) Date: Dec. 31, 2002

(87) PCT Pub. No.: WO02/05376

PCT Pub. Date: Jan. 17, 2002

(65) Prior Publication Data

US 2003/0102941 A1 Jun. 5, 2003

(30) Foreign Application Priority Data

Jul. 7, 2000 (JP) ..... 2000-206319

(51) Int. Cl.[7] ..... H01P 1/203
(52) U.S. Cl. ..... 333/204; 333/185; 333/202
(58) Field of Search ..... 333/116, 134, 333/170, 172, 181, 185, 202, 204, 219, 219.2

(56) References Cited

U.S. PATENT DOCUMENTS 5,396,201 A * 3/1995 Ishizaki et al. ..... 333/204
5,525,942 A 6/1996 Horii et al.
5,576,672 A * 11/1996 Hirai et al. ..... 333/204
5,719,539 A * 2/1998 Ishizaki et al. ..... 333/204

FOREIGN PATENT DOCUMENTS

| | | | |
|---|---|---|---|
| JP | 4-58721 | 9/1992 | ..... H01P/1/203 |
| JP | 7-58506 A | 3/1995 | ..... H01P/1/20 |
| JP | 7-93535 | 10/1995 | ..... H03B/5/18 |
| JP | 8-32309 A | 2/1996 | ..... H01P/1/205 |
| JP | 8-78907 | 3/1996 | ..... H01P/1/203 |
| JP | 2539115 | 7/1996 | ..... H01P/1/203 |
| JP | 11-205005 A | 7/1999 | ..... H01P/1/203 |
| JP | 2000-13106 | 1/2000 | ..... H01P/1/20 |

OTHER PUBLICATIONS

JP 7–58506 dated Mar. 3, 1995, first page only and Abstract.
JP 11–205005 dated Jul. 30, 1999, first page only and Abstract.
Konishi, Yoshihiro. "Design and Application of Communication Filter Circuit" Sogo Denshi Shuppan.
Blondy, Pierre, et al. IEEE MTT–S Digest, pp. 1181–1184, 1998.

* cited by examiner

*Primary Examiner*—Robert Pascal
*Assistant Examiner*—Dean Takaoka
(74) *Attorney, Agent, or Firm*—Birch, Stewart, Kolasch & Birch, LLP

(57) ABSTRACT

In a distributed constant filter, two λ/2 open line resonator are capacitive-coupled by an electromagnetic field coupling portion, and an input terminal and an output terminal are brought into mutual inductive coupling by an electromagnetic field coupling portion. The frequency of an attenuation pole can be close to a center frequency and the steepness of the filter characteristics can be increased.

12 Claims, 22 Drawing Sheets

FILTER CIRCUIT AND HIGH FREQUENCY COMMUNICATION CIRCUIT USING THE SAME

This application is the national phase under 35 U.S.C. §37of PCT International Application No. PCT/JP01/05286 which has an International filing date of Jun. 20, 2001, which designated the United States of America.

TECHNICAL FIELD

The present invention relates to a filter circuit and a high frequency communication circuit device using the same, and more particularly to a filter circuit selectively passing a predetermined frequency component of a signal input to an input terminal to an output terminal and a high frequency communication circuit device using the same.

BACKGROUND ART

In the low frequency band, most of filter circuits are fabricated by attaching discrete components such as coils or capacitors. In the high frequency band such as microwave or millimeter wave bands, however, they are usually fabricated with distributed constant type circuits.

FIG. 18 is a perspective view showing a configuration of an edge coupled filter as a representative distributed constant filter. This filter is provided for a micro-strip line that is most common as a distributed constant line. In FIG. 18, this filter includes a substrate 150 formed of an insulator such as alumina ceramic. A ground layer 151 is formed on the entire back surface of substrate 150. Lines 152 and 153 are part of the micro-strip line as a high frequency transmission line and respectively form an input terminal and an output terminal for the filter. Lines 154 and 155 form so-called λ/2 open line resonators. As used herein λ is a wavelength of the electrical signal transmitted through the line, in the frequency in the vicinity of the center frequency of the filter circuit. Generally, micro-strip lines 152 and 153 and λ/2 open line resonators 154 and 155 are collectively patterned with high accuracy on the surface of insulator substrate 150 by means of print or photolithography. Therefore the planar circuit filter having the structure in FIG. 18 is generally known as a filter circuit with low cost and with excellent productivity.

In the following, a distributed constant type filter circuit formed of micro-strip lines as shown in FIG. 18 will mainly be described in the present specification. The effect of the present invention, however, is not limited to such a filter. It can readily be applied to a filter circuit formed of a coplanar line or a semi-concentrated constant type filter with a part of circuit elements replaced with concentrated constant discrete components. Furthermore, in the following, only a planar view of a substrate seen from above will be shown as a view showing the structure of the distributed constant filter, for the sake of brevity, in the present specification.

Equivalent circuits having the structure of FIG. 18 are shown in FIGS. 19A and 19B. In the following, in the present specification, the equivalent circuit is shown in two stages to facilitate understanding. First, FIG. 19A is an equivalent circuit that is represented with great use of distributed constant line in a one-to-one correspondence with the structure of FIG. 18. However, the equivalent circuit including a distributed constant line as shown in FIG. 19A is inconvenient in a later simulation. Assuming that calculation is made using a commercially available high frequency circuit simulator, the calculation results somewhat vary depending products and manufactures and methods of defining parameters are so varied to understand. In the present specification, an equivalent circuit with only concentrated constant in FIG. 19B is illustrated together, and the simulation is mainly performed using the equivalent circuit with only concentrated constant. The two types of equivalent circuits in FIGS. 19A and 19B are equivalent in the vicinity of resonance frequency of the filter. This is because a λ/2 open line resonator is equivalent to an LC parallel resonance circuit having one end grounded in the vicinity of its resonance frequency.

In FIGS. 19A and 19B, an LC parallel resonance circuit 154 including a coil 154*a* and a capacitor 154*b* having one end grounded and an LC parallel resonance circuit 155 including a coil 155*a* and a capacitor 155*b* having one end grounded correspond to λ/2 open line resonators 154 and 155 in FIG. 18, respectively. Each of coils 154*a* and 155*b* has a prescribed inductance L1 and each of capacitors 154*b* and 155*b* has a prescribed capacitance C1. This is because, in the resonance frequency, the middle portion of the λ/2 open line resonator is equivalently grounded and the impedance is close to infinity at both open ends. Capacitors 156 and 157 having a capacitance C2 in FIGS. 19A and 19B correspond to electromagnetic field coupling portions 156 and 157 in FIG. 18. In electromagnetic field coupling portions 156 and 157, micro-strip lines 152 and 153 and λ/2 open line resonators 154 and 155 are arranged closely spaced apart from each other at the open ends approximately by λ/4 or less. In such a case, it is known that electromagnetic field coupling occurs based on capacitive coupling. Capacitor 158 having a capacitance C3 in FIGS. 19A and 19B corresponds to an electromagnetic field coupling portion 158 in FIG. 18. In electromagnetic field coupling portion 158, lines 154 and 155 are arranged close to each other at the open ends. In this case, it is known that electromagnetic field coupling occurs based on capacitive coupling.

The present invention aims at a filter circuit for use in extremely high frequency band such as millimeter wave band, in particular. An exemplary equivalent circuit in FIG. 19B that is optimally designed for 60 GHz band is shown. FIGS. 20A and 20B are frequency characteristics graphs of that filter. The passband is designed as 58–61 GHz consistently in the present specification. Assume C1=0.3661 pF, C2=0.0527 pF, C3=0.02884 pF, L1=0.01699 nH. In FIGS. 20A and 20B, the axis of abscissas represents the frequency [GHz] and the axis of ordinates represent the absolute value of S parameters expressed in dB. In FIGS. 20A and 20B, S21 representing the pass characteristics and S11 representing the reflection characteristics are plotted at the same time. FIG. 20A shows the characteristics of the wide band and FIG. 20B shows the characteristics of the vicinity of the passband. As can be seen from FIGS. 20A and 20B, the filter having the structure in FIG. 18 functions as a bandpass filter.

In the following, the graphs in the formats shown in FIGS. 20A and 20B will be used to express the filter characteristics. Furthermore, in the present specification, the operation principle of the filter will be described, as shown in FIGS. 18–20B, by first showing the structure, then showing the equivalent circuit thereof, and finally showing the calculation result of the filter characteristics of the equivalent circuit. It is noted that in a second embodiment of the present invention, the effectiveness of the present invention is validated by showing the measurement result of the filter that was actually prototyped rather than only by calculation results.

Bandpass filters with high steepness are in the greatest demand among the filters. For local filters or image filters for the extremely high frequency band such as the millimeter wave band, filters with high steepness are essential, as the passband is in the close vicinity of the attenuation band. On the contrary, for example the filter of FIG. 18 results in the filter characteristics that are gradual with poor steepness as shown in FIGS. 20A and 20B, without some special scheme. Then, in order to improve the steepness of such a bandpass filter, the design method of creating attenuation poles at the frequencies immediately above and below the passband has been developed.

Some specific structures of such a filter having attenuation poles at the frequencies above and below the passband have already been presented in the academy. Among others, for example, a circuit shown in FIG. 21 has been known as a circuit that achieves satisfactory results in the extremely high frequency band such as the millimeter wave band and has a simple structure for facilitating design ("Low Loss Micromachined Filters For Millimeter-Wave Telecommunication Systems", Pierre Blondy et al., 1998 IEEE MTT-S Digest, pp. 1181–1184).

In FIG. 21, this filter includes an insulator substrate 161 formed of alumina ceramic or the like, micro-strip lines 162 and 163 formed on the surface thereof, and λ/2 open line resonators 164 and 165. Portions 167–170 enclosed by dotted lines are portions where lines 162–165 are close to each other to cause electromagnetic field coupling. It is noted that attention has to be made to the following two points in referring to the aforementioned reference (MTT-S Digest). First, the aforementioned reference assumes that it is characterized in that low loss can be attained by the micromachine technique. However, this is not essential in the operation principle of the filter, and the operation principle itself is same as the filter in FIG. 21. Second, the aforementioned reference describes both of a filter (two-pole filter) having two λ/2 open line resonators and a filter (four-pole filter) having four λ/2 open line resonators. The effect of the invention will be discussed in vain unless the filters are compared under the same conditions. The discussion in the present specification is consistently based on the filter (two-pole filter) having two λ/2 open line resonators, for the sake of brevity.

FIGS. 22A and 22B are circuit diagrams showing the equivalent circuit of the filter in FIG. 21. FIG. 22A is an equivalent circuit with great use of distributed constant line and FIG. 22B is an equivalent circuit represented with only distributed constant. In FIGS. 22A and 22B, an LC parallel resonance circuit 164 including a coil 164*a* and a capacitor 164*b* having one end grounded and an LC parallel resonance circuit 165 including a coil 165*a* and a capacitor 165*b* having one end grounded correspond to λ/2 open line resonators 164 and 165 in FIG. 21, respectively. Each of coils 164*a* and 165*a* has a prescribed inductance L1 and each of capacitors 164*b* and 165*b* has a prescribed capacitance C1. Capacitors 168 and 169 having a capacitance C2 in FIGS. 22A and 22B correspond to electromagnetic field coupling portions 168 and 169 in FIG. 21, respectively. A capacitor 167 having a capacitance C3 in FIGS. 22A and 22B corresponds to an electromagnetic field coupling portion 167 in FIG. 21. The coefficient of mutual induction coupling K of FIGS. 22A and 22B corresponds to an electromagnetic field coupling portion 170 in FIG. 21. In electromagnetic field coupling portion 170, the middle portions of two λ/2 open line resonators 164 and 165, that is, the portions where the current is maximum are arranged to align closely parallel to each other. In this case, it is known that electromagnetic field coupling based on mutual inductive magnetic field coupling occurs.

An exemplary equivalent circuit in FIG. 22B that is optimally designed for 60 GHz band is shown. FIGS. 23A and 23B are graphs showing the frequency characteristics of that filter. Assume that C1=0.3546 pF, C2=0.05981 pF, C3=0.00687 pF, L1=0.01846 nH, K=0.0914. As can be seen from FIG. 23A, the following changes take place as compared with FIG. 20A. Attenuation poles are formed at the frequencies above and below the passband, and the steepness of the filter is increased in the vicinity of these attenuation poles. At the attenuation pole on the lower frequency side (48 GHz), S21 in FIG. 20A is −30 dB whereas S21 in FIG. 23A is −50 dB or below. At the attenuation pole on the higher frequency side (69 GHz), S21 in FIG. 20A is −17 dB whereas S21 in FIG. 23A is −50 dB or below. In other words, in a case of a radio communication device in which a local frequency happens to be positioned at 48 GHz relative to the center frequency of 60 GHz, the filter characteristics in FIGS. 23A and 23B are more advantageous than the filter characteristics of FIGS. 20A and 20B, as it provides more attenuation amount.

The filter of the equivalent circuit in FIG. 22A, 22B is a commonly known circuit configuration and is described in many references. For example, it is described in the second chapter of "Design and Application of Communication Filter Circuit" (edited and authored by Yoshihiro Konishi, Sogo Denshi Shuppan), which is a prominent text book of the high frequency filter technique.

PROBLEMS TO BE SOLVED BY THE INVENTION

The conventional filter, however, has the problem in that the steepness of the filter is not sufficient when it is used in a radio communication device for the extremely high frequency band such as the millimeter wave band, in particular. As the frequencies at two attenuation poles are closer to the frequency of the passband (for example 59–62 GHz), the steepness of the filter characteristics becomes high. In the case of the filters in FIGS. 19A and 19B, however, the steepness of the graph in FIGS. 23A and 23B approaches its limit, which can be confirmed easily with a common circuit simulation. Although the specific values vary depending on minute condition settings such as specific bandwidth or attenuation amount, for the filter characteristics of FIGS. 23A and 23B, for example, the frequencies at the attenuation poles can be set only at the frequencies as far as 15% or more apart when represented as being standardized by the center frequency. If the attenuation poles are forced to be closer, the waveform of the filter characteristics is distorted.

In an attempt to use a filter for attenuating a local signal, the conventional filter having the characteristics of FIGS. 23A and 23B is sufficient as long as the local frequency is positioned at 48 GHz relative to the center frequency 60 GHz. In most of the actual millimeter wave radio communication device, however, the local frequency is often positioned at the frequency closer to the center frequency 60 GHz, for example 57 GHz or 58 GHz. In such a case, with the conventional filter, the steepness is not sufficient and the attenuation amount cannot be assured.

It is noted that in the discussion of this problem the steepness of the filter varies depending on the minute condition settings such as specific bandwidth or attenuation amount. For example, referring to the characteristics (FIG. 3) of the filter (two-pole filter) under the same conditions as those described in the aforementioned reference (MTT-S Digest), the frequencies at the attenuation poles successively come to dose at more than 8% when represented as being standardized by the center frequency. The main reason for this, however, is simple: the filter contemplated in the aforementioned reference is for a band quite narrower than the filter contemplated in the present specification (specific bandwidth=3.5%). The steepness of the filter is easier to understand in its effect in the discussion of the somewhat wider band. Therefore all the filters with the graphs in the present specification are unified with the specific bandwidth of more than 5%. Furthermore, the comparison of the filter performance has difficulty in that an accurate comparison cannot be made unless a variety of conditions are unified. For these reasons, in the present specification, the filters are evaluated based on the simulation results of the equivalent circuits for the purpose of unifying the conditions. In addition, an optimum design function of a common, commercially available circuit simulation program was used since an accurate comparison is difficult with a manual design in determining the circuit constant of the equivalent circuit.

DISCLOSURE OF THE INVENTION

The present invention is made to solve the problems described above and the object is to provide a filter circuit having steep filter characteristics.

In accordance with the present invention, a filter circuit includes: a plurality of resonators wherein an impedance between respective input/output terminals and a reference potential line is maximum in each resonance frequency and each input/output terminal is capacitive-coupled to at least one of other input/output terminals; first capacitive coupling means for capacitive-coupling input/output terminals of any two resonators of the plurality of resonators and first and second terminals respectively to each other; and electromagnetic field coupling means for connecting the first and second terminals respectively to the input terminal and the output terminal and bringing the input terminal and the output terminal into magnetic field coupling by mutual induction. Therefore the frequency at an attenuation pole can be close to a center frequency without degrading the waveform of the filter characteristics and the steepness of the filter characteristics can be increased.

Preferably, second capacitive coupling means for capacitive-coupling the input terminal and the output terminal to each other is further included. In this case, the number of attenuation poles can be increased and an attenuation amount of the cut-off band can be increased.

Preferably, the filter circuit is formed of a line pattern made of a conductor formed on an insulator substrate. Each of the plurality of resonators includes a first line having a predetermined line length. At least one end portion of both end portions of each first line is capacitive-coupled to one end portion of another first line. The first capacitive coupling means includes third and fourth lines having respective one end portions capacitive-coupled to the other end portions of two first lines included in the two resonators and having respective other end portions connected to the first and second terminals. The electromagnetic field coupling means includes fifth and sixth lines connected between the first and second terminals and the input terminal and the output terminal, respectively, each having at least a part arranged parallel to the other in proximity. In this case, the filter circuit can be realized with a planar print circuit thereby allowing for reduction in size and cost of the circuit.

Preferably, in accordance with another aspect of the present invention, a filter circuit includes: a plurality of resonators wherein an impedance between respective input/output terminals and a reference potential line is maximum in each resonance frequency and each input/output terminal is capacitive-coupled to at least one of other input/output terminals; first capacitive coupling means for capacitive-coupling input/output terminals of any two resonators of the plurality of resonators and first and second terminals respectively to each other; electromagnetic field coupling means for connecting the first and second terminals respectively to the input terminal and the output terminal and bringing the input terminal and the output terminal into magnetic field coupling by mutual induction; and second capacitive coupling means for capacitive-coupling the input terminal and the output terminal to each other. Each of the plurality of resonators includes a first line having a predetermined line length. At least one end portion of both end portions of each first line is capacitive-coupled to one end portion of another first line. The first capacitive coupling means includes third and fourth lines having respective one end portions capacitive-coupled to the other end portions of two first lines included in the two resonators and having respective other end portions connected to the first and second terminals. The electromagnetic field coupling means includes fifth and sixth lines having respective one end portions respectively connected to the first and second terminals, each having at least a part arranged parallel to the other in proximity. The second capacitive coupling means includes seventh and eighth lines connected between the other end portions of the fifth and sixth lines and the input terminal and the output terminal, respectively, and each having at least a part arranged proximate to the other. Therefore the frequency at the attenuation pole can be close to the center frequency without degrading the waveform of the filter characteristics and the steepness of the filter characteristics can be increased. Moreover, the filter circuit can be realized with a planar print circuit thereby allowing for reduction in size and cost of the circuit.

Preferably, the fifth and sixth lines are proximate to each other at a position of a quarter wave of a signal having a center frequency of the filter circuit from open ends of the third and fourth lines. In this case, since the current value is maximum in the fifth and sixth lines, the mutual inductive magnetic field coupling between the fifth and sixth lines can be created in a limited space efficiently.

Preferably, each of the plurality of resonators is a quarter wave short-circuited line resonator or a half wave open line resonator. In this case, the filter circuit can be realized with a planar print circuit thereby allowing for reduction in size and cost of the circuit.

In accordance with the present invention, the filter circuit is used as a part of a multiplexer type filter circuit. In this case, the multiplexer circuit can be improved in performance and reduced in cost and size.

In a high frequency communication circuit device in accordance with the present invention, the filter circuit described above is used as a high frequency circuit for removing a local signal or an image signal. In this case, a high frequency communication circuit device can be improved in performance and reduced in cost and size.

BEST MODES FOR CARRYING OUT THE INVENTION

First Embodiment

Figure 1:
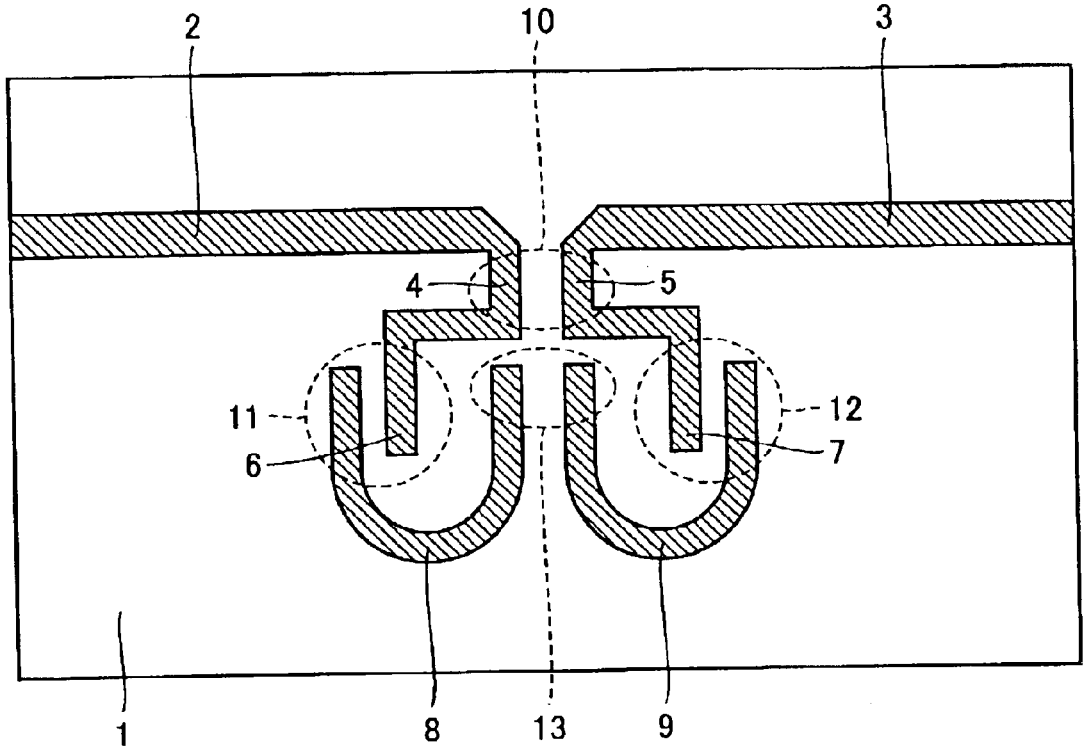
FIG. 1 is a plan view of a configuration of a distributed constant filter in accordance with a first embodiment of the present invention.

FIG. 1 is a view showing a configuration of a distributed constant filter in accordance with a first embodiment of the present invention. In FIG. 1, this distributed constant filter includes an insulator substrate 1 formed of an insulator such as alumina ceramic, and a line pattern formed on insulator substrate 1. A ground layer, that is, a grounded electrode is formed on the entire back surface of insulator substrate 1.

The line pattern includes lines 2–9. Lines 2 and 3 are arranged with a prescribed interval on a straight line. Lines 2 and 3 are part of a micro-strip line and respectively form an input terminal and an output terminal of the filter. An electrical signal having a wavelength λ is transmitted through the micro-strip line.

Lines 4 and 5 are arranged parallel to each other in close proximity, and have their one end portions respectively connected to the end portions of lines 2 and 3. Lines 4 and 5 are arranged orthogonal to lines 2 and 3, respectively. Lines 4 and 5 form an electromagnetic field coupling portion 10. Lines 6 and 7 are both formed in L-shape and have their one end portions respectively connected to the other end portions of lines 4 and 5. The one sides of lines 6 and 7 are arranged parallel to lines 2 and 3, respectively, and the other sides are arranged in a direction orthogonal to lines 2 and 3, respectively. The distance from the open end of line 6, 7 to electromagnetic field coupling portion 10 is set to λ/4.

Lines 8 and 9 are both formed in U-shape and have their one sides arranged parallel to the other sides of lines 6 and 7, respectively, at a distance of about λ/4 or less and their other sides arranged parallel at a distance of about λ/4 or less. The other side of line 6 and the one side of line 8 form an electromagnetic field coupling portion 11, the other side of line 7 and the one side of line 9 form electromagnetic field coupling portion 12, and the other sides of lines 8 and 9 form an electromagnetic field coupling portion 13. Each of lines 8 and 9 forms a λ/2 open line resonator.

Figure 2A:
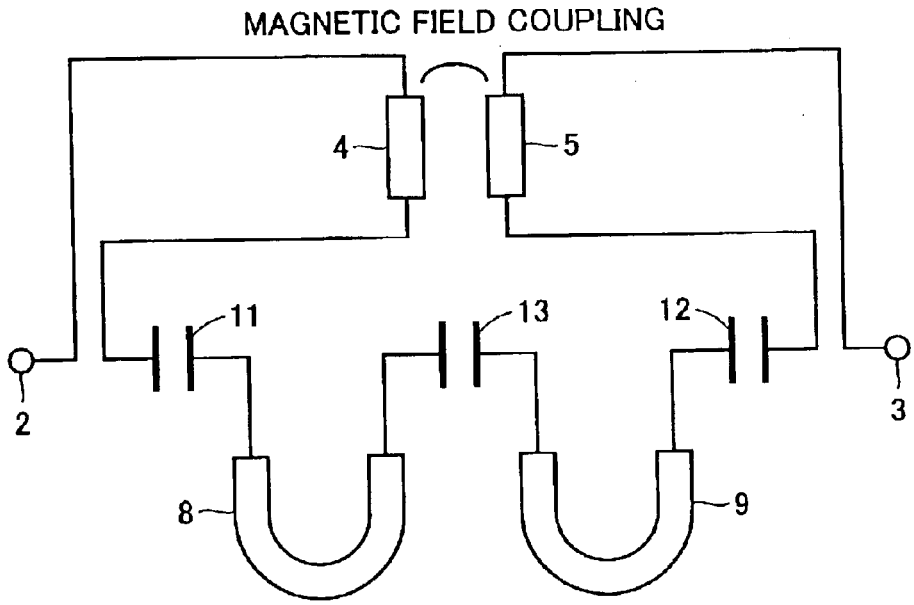
FIGS. 2A and 2B are circuit diagrams showing equivalent circuits of the filter shown in FIG. 1.
Figure 2B:
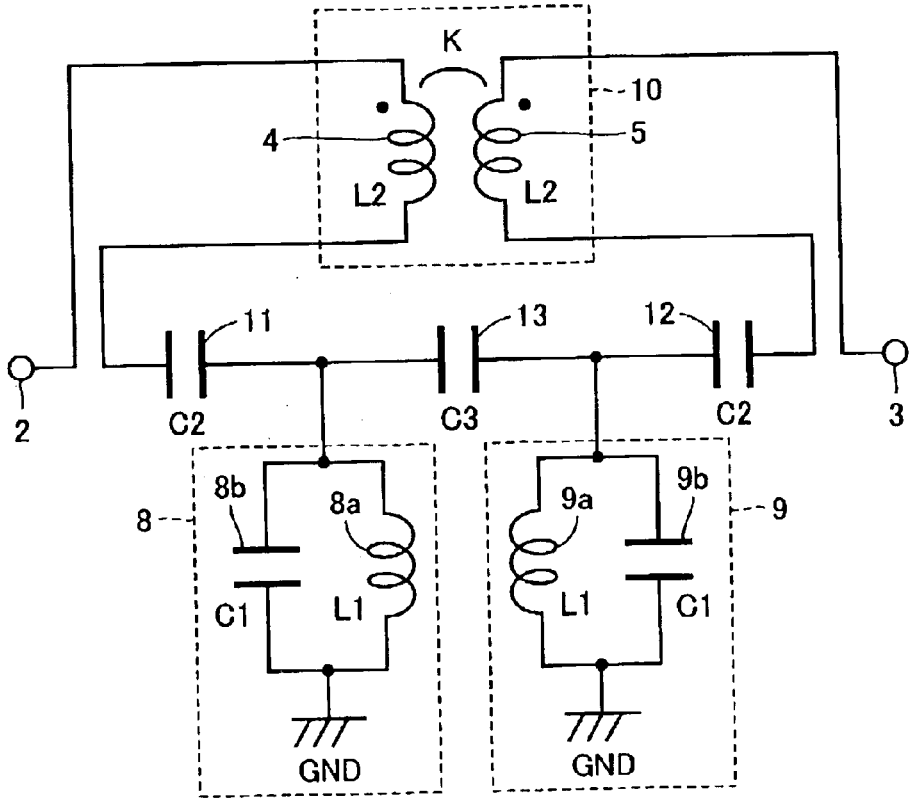

FIGS. 2A and 2B are circuit diagrams showing equivalent circuits of the filter. FIG. 2A is a circuit diagram with great use of distributed constant line and FIG. 2B is a circuit diagram with only concentrated constant.

In FIGS. 2A and 2B, the λ/2 open line resonator formed of line 8 is equivalent to an LC parallel resonance circuit including a coil 8*a* and a capacitor 8*b*. Coil 8*a* has a prescribed inductance C1 and has its one electrode grounded. Capacitor 8*b* has a prescribed capacitance C1 and has its one electrode grounded. This is because, in the resonance frequency, the middle portion of line 8 is equivalently grounded and the impedance at the both ends becomes infinite. The λ/2 open line resonator formed of line 9 is equivalent to an LC parallel resonance circuit including a coil 9*a* and a capacitor 9*b*. Coil 9*a* has a prescribed inductance L1 and has its one electrode grounded. Capacitor 9*b* has a capacitance C1 and has its one electrode grounded.

Electromagnetic field coupling portion 11 is equivalent to a capacitor having a prescribed capacitance C2. This is because the open ends of lines 6 and 8 are arranged close to each other at a distance of about λ/4 or less and in this case electromagnetic field coupling based on capacitive coupling occurs. Similarly, electromagnetic field coupling portion 12 is equivalent to a capacitor having a prescribed capacitance C2. Electromagnetic field coupling portion 13 is equivalent to a capacitor having a prescribed capacitance C3.

In electromagnetic field coupling portion 10, lines 4 and 5 are equivalent to two coils that have a prescribed inductance L2 and are coupled to each other with the coefficient of mutual induction K. This is because electromagnetic field coupling based on mutual inductive magnetic field coupling occurs when those parts of two lines 4 and 5 which are not the open ends are arranged parallel to each other in dose proximity. Since this filter is designed such that the distance from the open end of line 6, 7 to electromagnetic field coupling portion 10 is set to λ/4, the position of electromagnetic field coupling portion 10 is the current maximum point and the mutual inductive magnetic field coupling is readily created. Therefore the mutual inductive coupling is created efficiently in a limited space.

As described above, in the equivalent circuit of the filter, the one electrodes of coil 8*a* and capacitor 8*b* of LC parallel resonance circuit 8 are grounded and the other electrodes of coil 8*a* and capacitor 8*b* are connected to an input terminal 2 through a capacitor 11 and a coil 4. The one electrodes of coil 9*a* and capacitor 9*b* of LC parallel resonance circuit 9 are grounded and the other electrodes of coil 9*a* and capacitor 9*b* are connected to an output terminal 3 through a capacitor 12 and a coil 5. The other electrodes of coil 8*a* and capacitor 8*b* are connected to the other electrodes of coil 9*a* and capacitor 9*b* through a capacitor 13. Coils 4 and 5 are brought into mutual inductive magnetic field coupling.

Figure 3A:
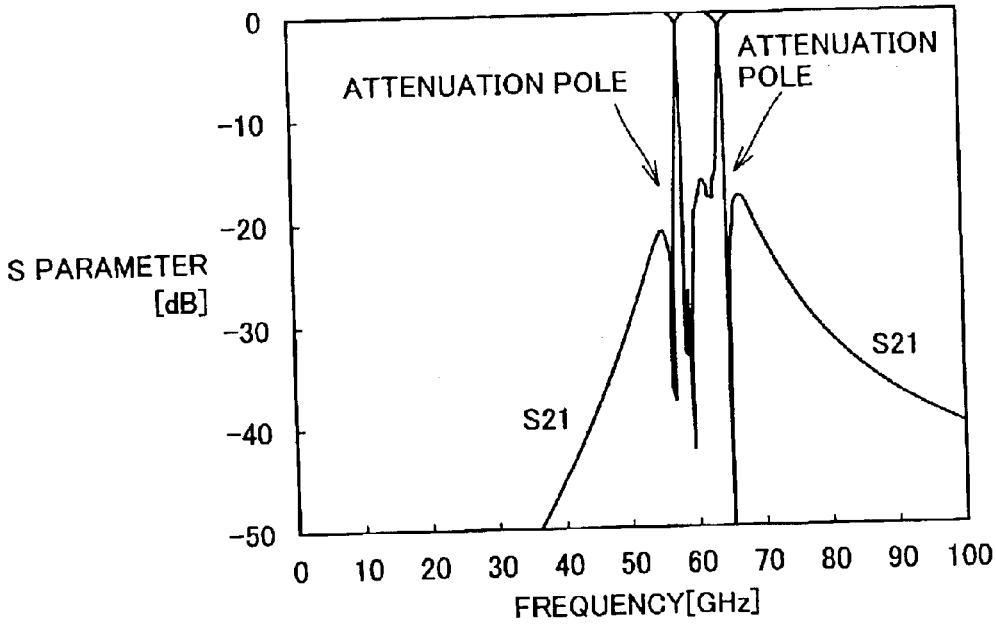
FIGS. 3A and 3B are graphs showing the filter characteristics of the equivalent circuits shown in FIGS. 2A and 2B.
Figure 3B:
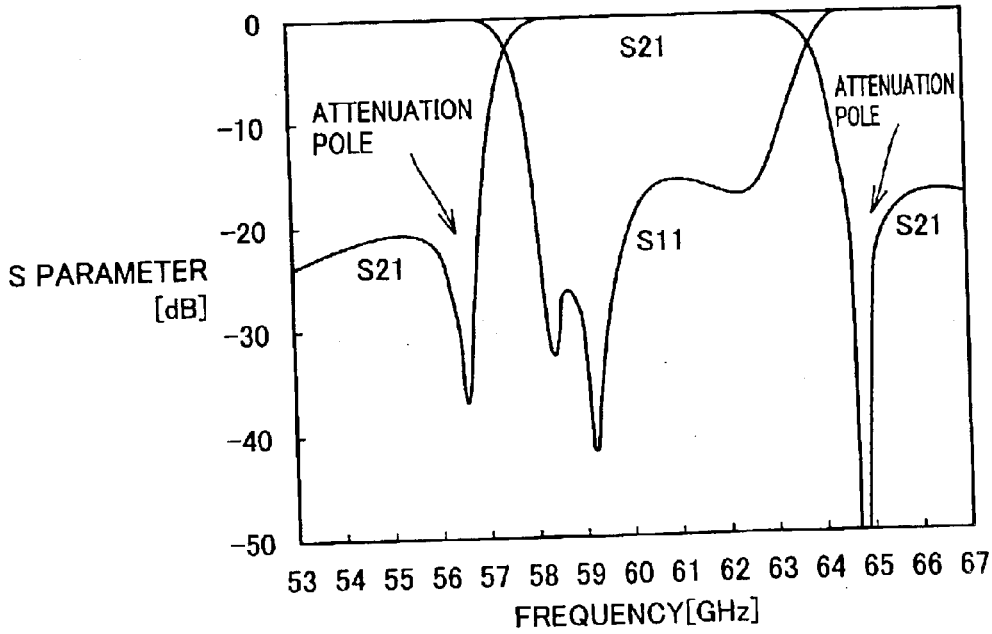

FIGS. 3A and 3B are graphs showing the frequency characteristics of the equivalent circuits shown in FIGS. 2A and 2B. Here it is assumed that C1=0.8201 pF, C2=0.005445 pF, C3=0.06153 pF, L1=0.00786 nH, L2=1.257 nH, K=0.0319, and the center frequency is 60 GHz.

Figure 20A:
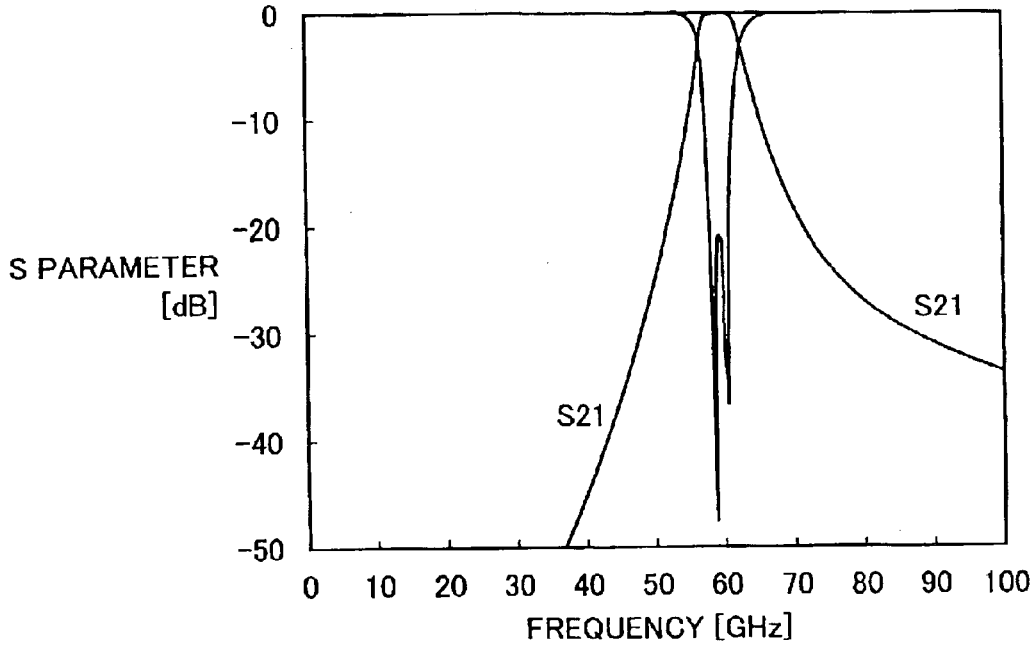
FIG.20A PRIOR ART
FIGS. 20A and 20B are graphs showing the filter characteristics of the equivalent circuits shown in FIGS. 19A and 19B.
Figure 20B:
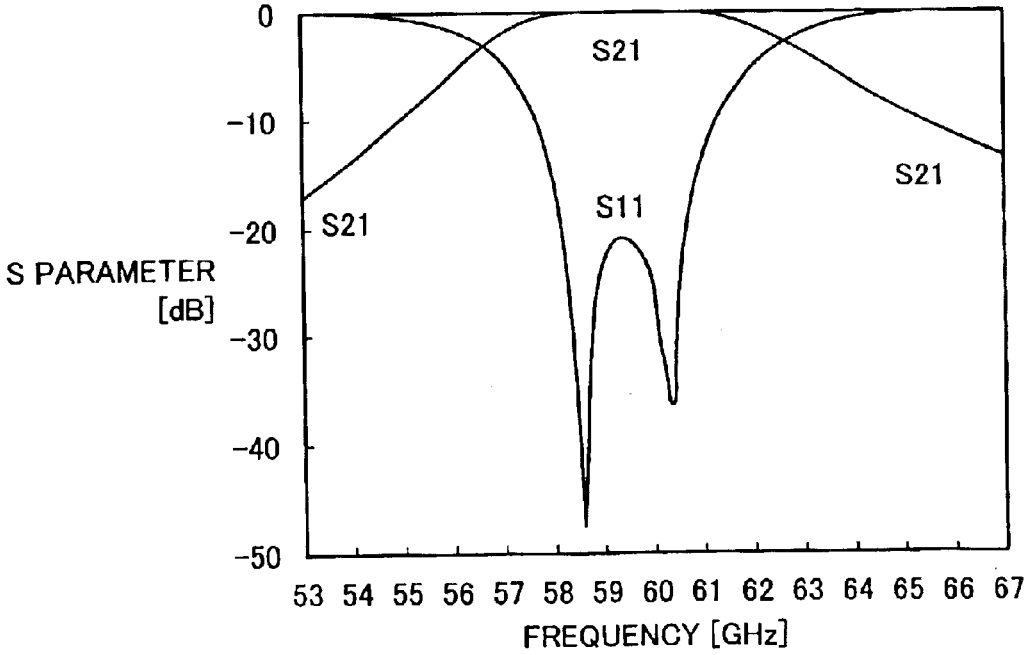
FIG.20B PRIOR ART
Figure 21:
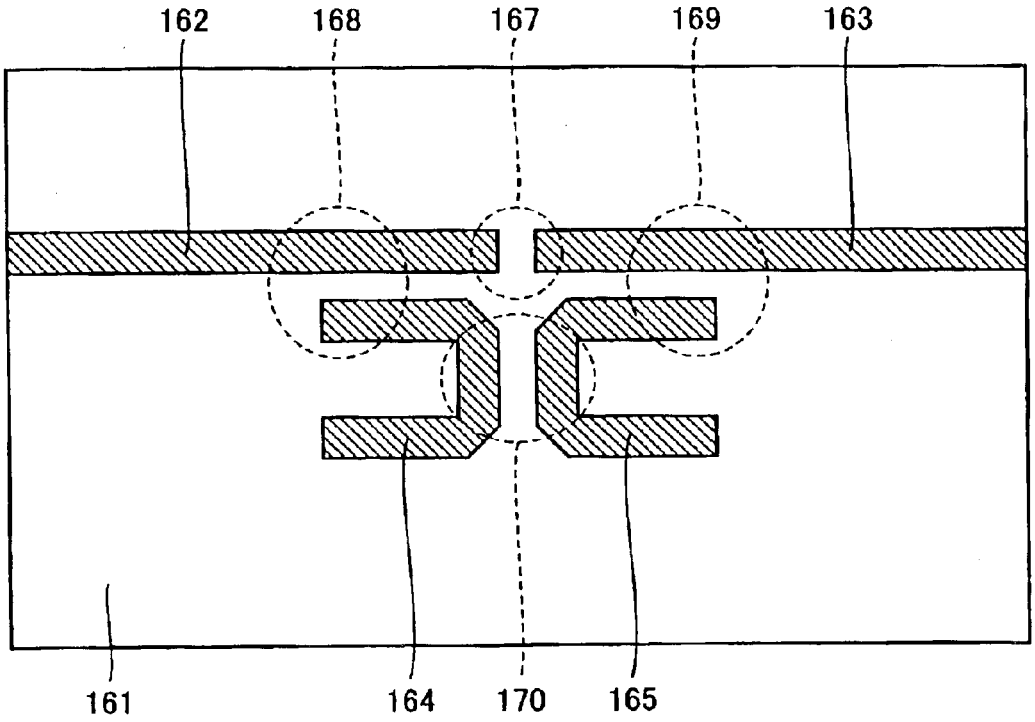
FIG.21 PRIOR ART
FIG. 21 is a plan view showing a configuration of another conventional distributed constant filter.
Figure 22A:
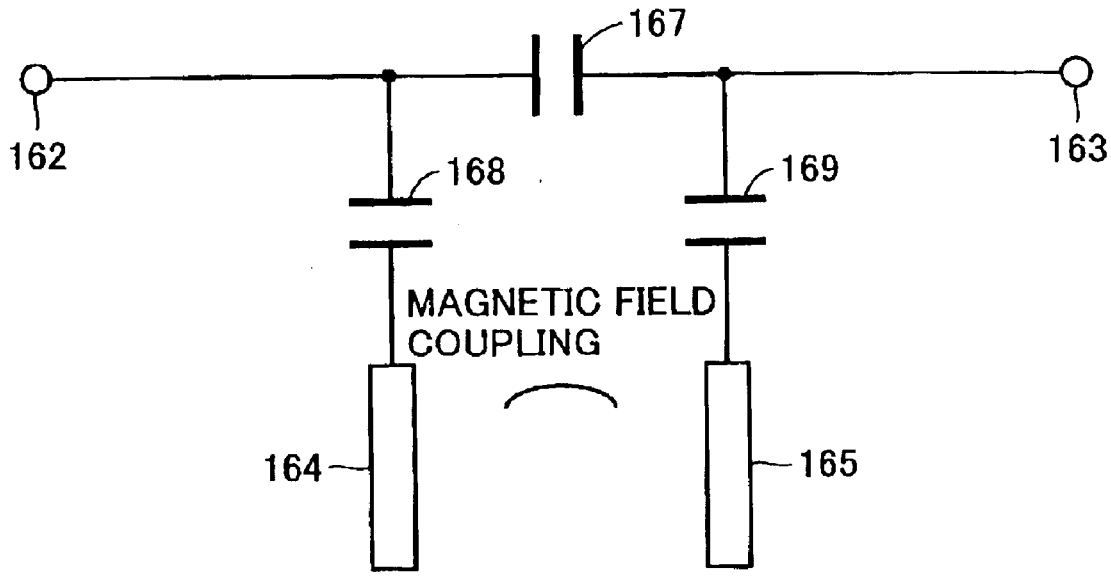
FIG.22A PRIOR ART
FIGS. 22A and 22B are circuit diagrams showing equivalent circuits of the filter shown in FIG. 21.
Figure 22B:
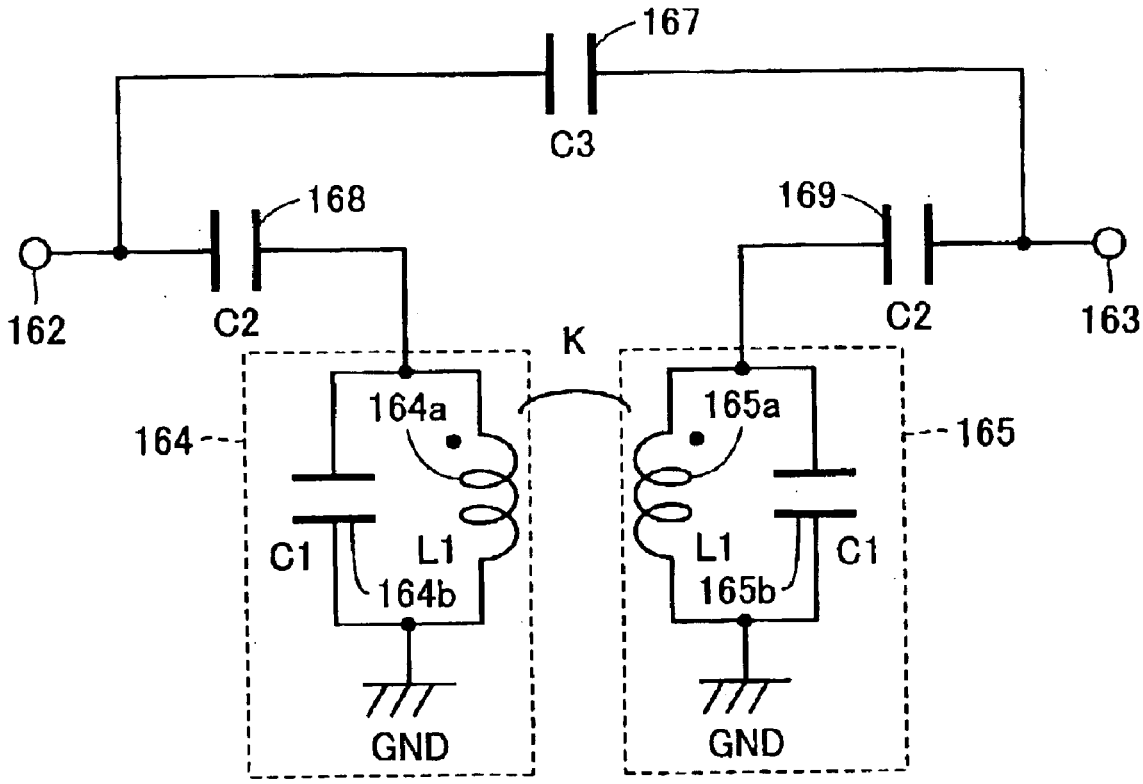
FIG.22B PRIOR ART
Figure 23A:
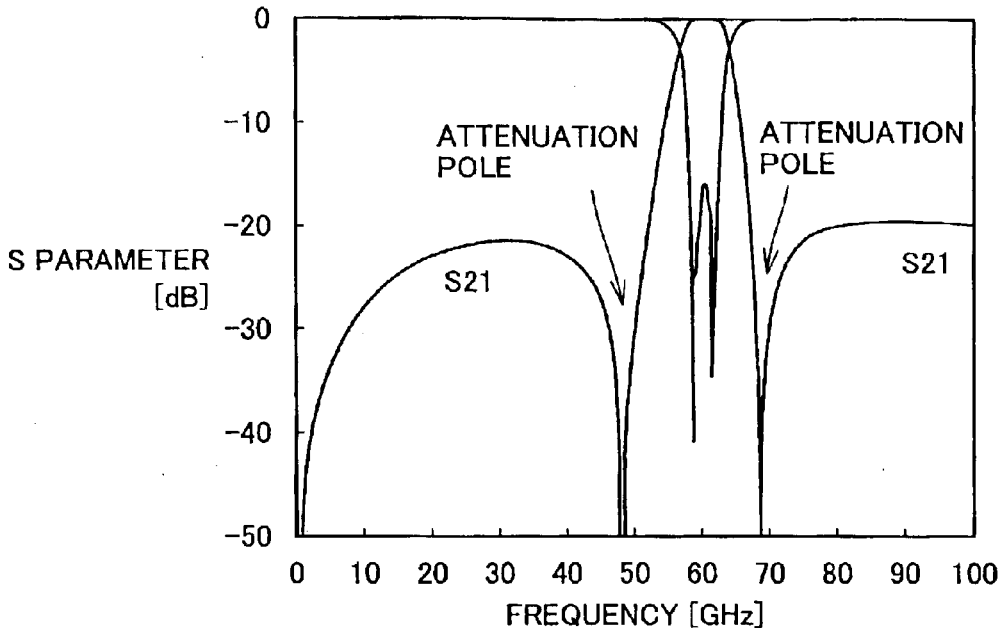
FIG.23A PRIOR ART
FIGS. 23A and 23B are graphs showing the filter characteristics of equivalent circuits shown in FIGS. 22A and 22B.
Figure 23B:
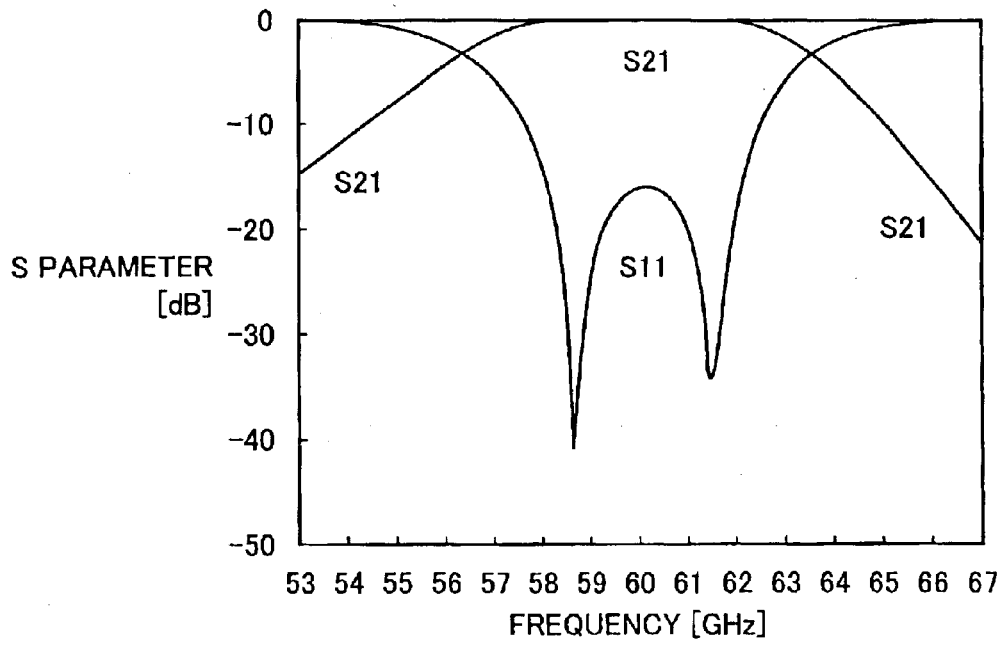
FIG.23B PRIOR ART

As compared with the conventional filter characteristics in FIGS. 20 and 23, it can be seen that the steepness is significantly improved. In other words, even when two attenuation poles above and below the passband approach to the closest vicinity of the passband, the filter waveform is not distorted and the bandpass characteristics close to an ideal rectangle can be obtained. In FIGS. 3A and 3B, the frequencies at attenuation poles are apart by only less than 8% when represented as being standardized by the center frequency. This value is almost half as compared with the filter characteristics for example in FIGS. 23A and 23B.

Second Embodiment

Referring to FIGS. 3A and 3B, it is certain that the steepness of the filter characteristics is significantly increased, but still improvements can be made in the following point. Although S21 in the attenuation region in close vicinity of the passband (for example 53–56 GHz) is below −20 dB, it is desirable to further increase this attenuation amount. The attenuation amount cannot be increased in FIGS. 3A and 3B because there is only one attenuation pole in this band. With only one attenuation pole, the attenuation amount can be increased only in a narrow frequency range. Therefore a filter in FIG. 4 was invented as the second embodiment of the present invention.

Figure 4:
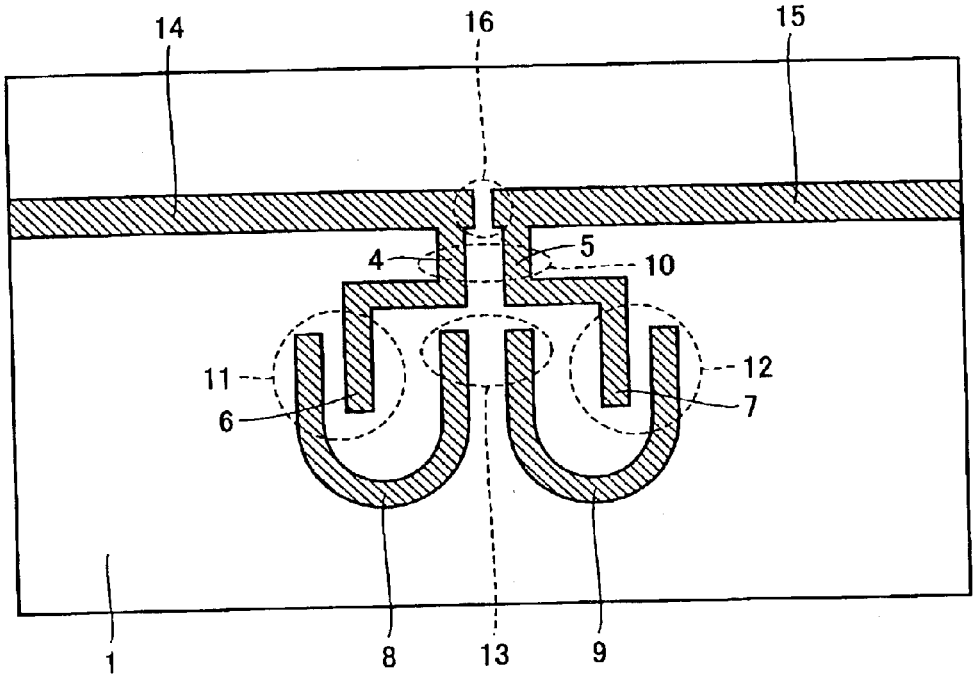
FIG. 4 is a plan view showing a configuration of a distributed constant filter in accordance with a second embodiment of the present invention.

Referring to FIG. 4, this filter differs from the filter in FIG. 1 in that lines 2 and 3 are replaced with lines 14 and 15, respectively. Lines 14 and 15 are part of micro-strip line and respectively form an input terminal and an output terminal of the filter. Lines 14 and 15 are arranged on a straight line. The end portion of line 14 and the end portion of line 15 are arranged proximately at a distance of about λ/4 or less and form an electromagnetic field coupling portion 16.

Figure 5A:
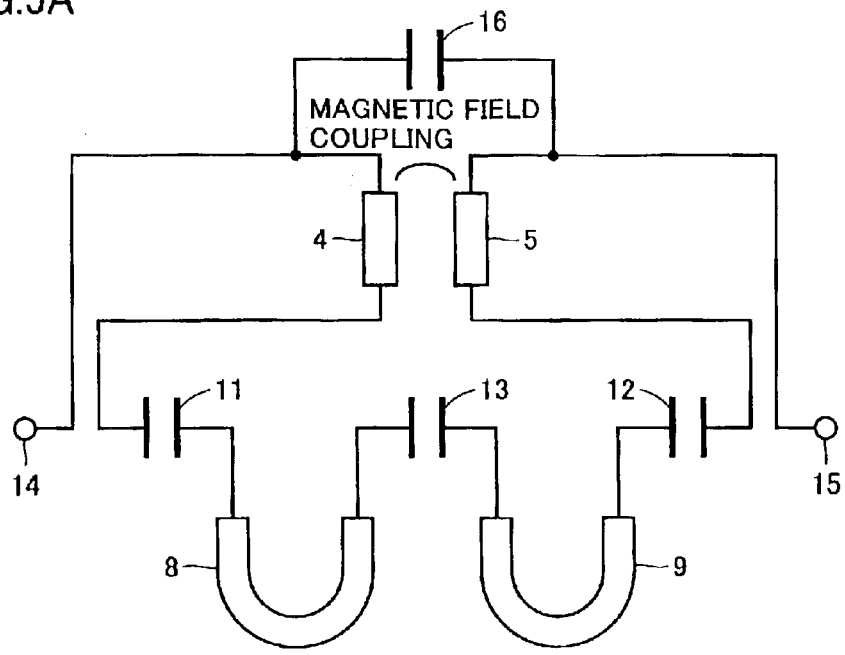
FIGS. 5A and 5B are circuit diagrams showing equivalent circuits of the filter shown in FIG. 4.
Figure 5B:
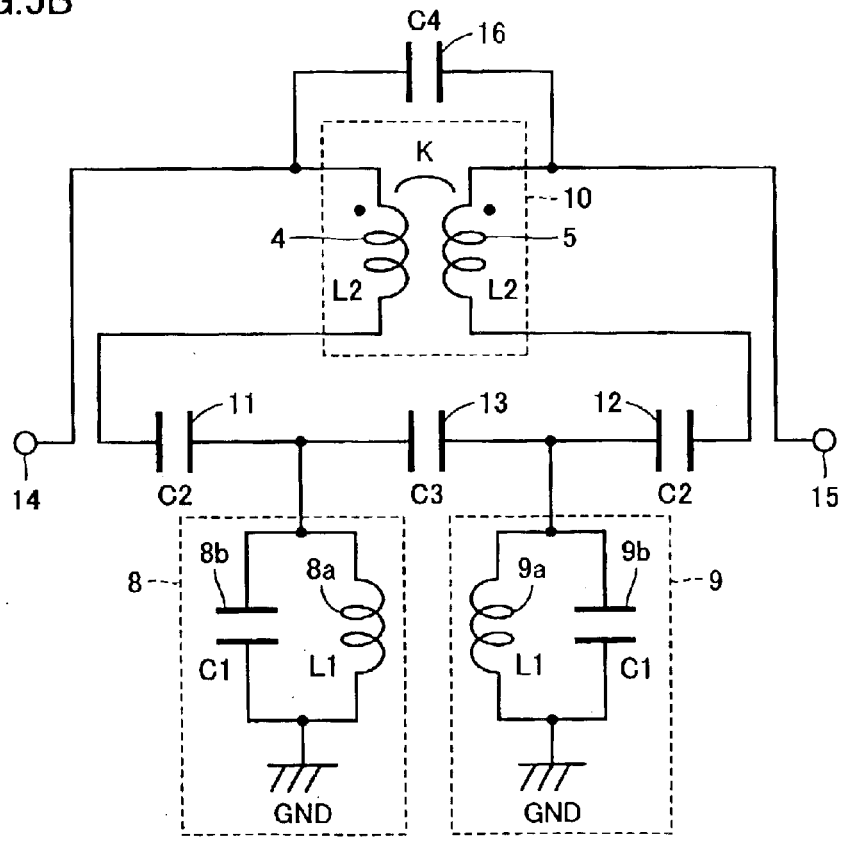

FIGS. 5A and 5B are circuit diagrams showing equivalent circuits of the filter shown in FIG. 4. FIG. 5A is a circuit diagram with great use of distributed constant line and FIG. 5B is a circuit diagram with only distributed constant.

In FIGS. 5A and 5B, electromagnetic field coupling portion 16 is equivalent to a capacitor having a prescribed capacitance C4. This is because the open ends of lines 14 and 15 are arranged close to each other at a distance of about λ/4 or less and in such coupling the electromagnetic field coupling based on capacitive coupling occurs. Therefore in this equivalent circuit, a capacitor 16 is connected between an input terminal 14 and an output terminal 15. The remaining configuration is same as the filter shown in FIGS. 1 and 2 and the description thereof will not be repeated.

Figure 6A:
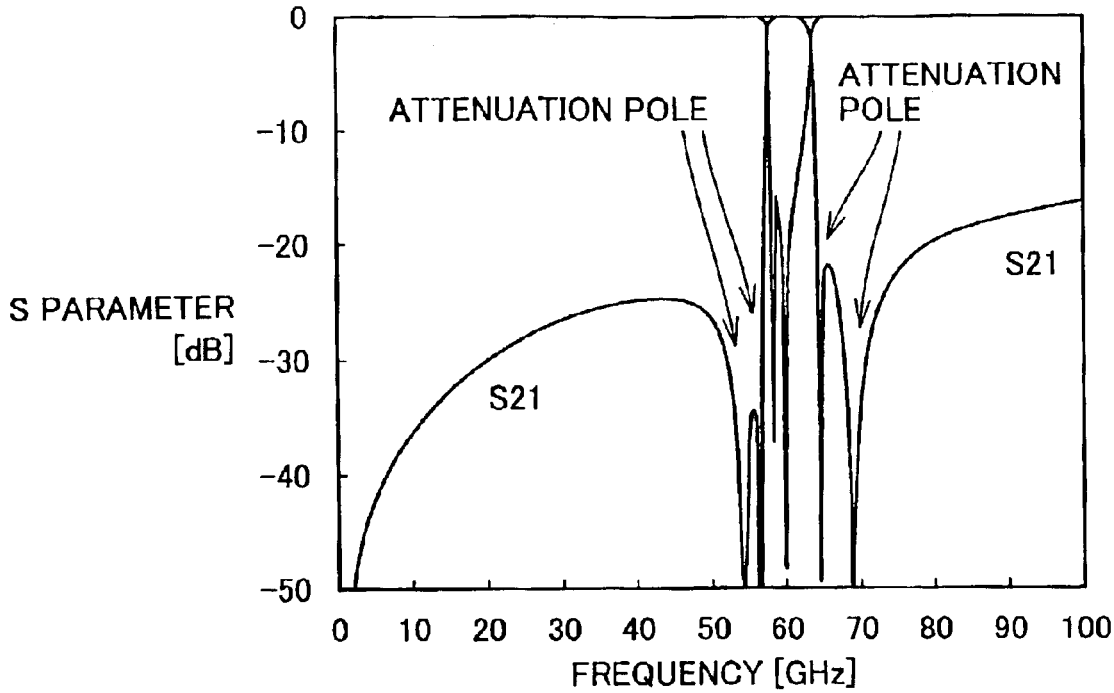
FIGS. 6A and 6B are diagrams showing the filter characteristics of the equivalent circuits shown in FIGS. 5A and 5B.
Figure 6B:
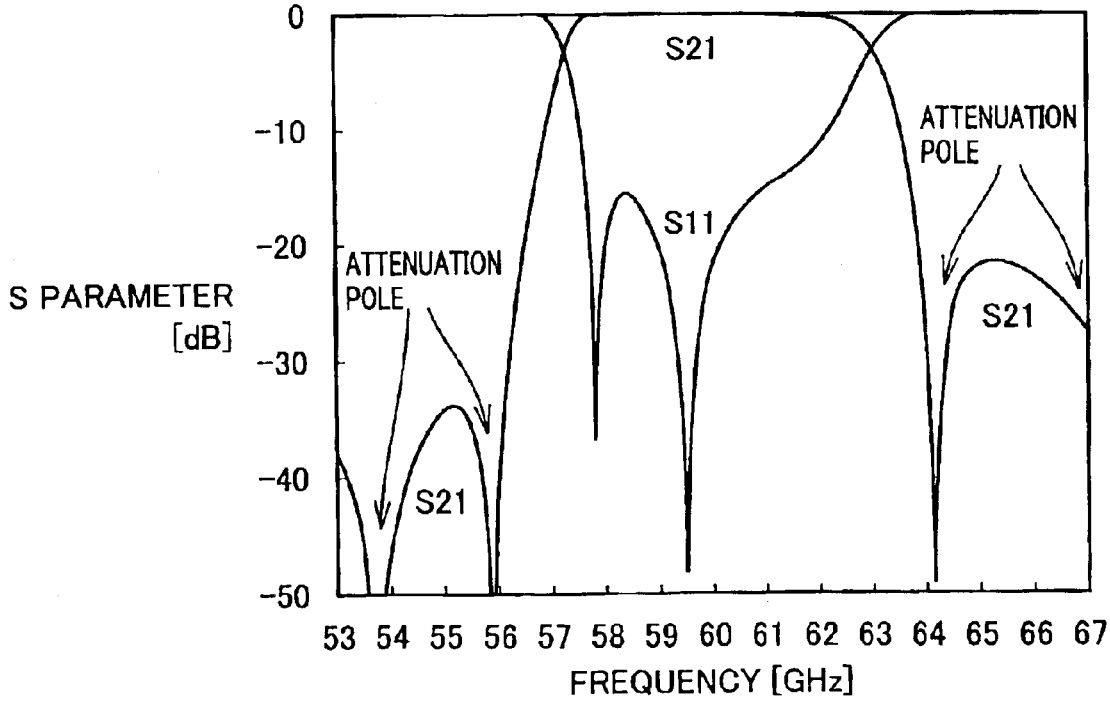

FIGS. 6A and 6B are graphs showing the frequency characteristics of the equivalent circuit shown in FIG. 5B. Here it is assumed that C1=0.8811 pF, C2=0.005513 pF, C3=0.0595 pF, C4=0.002618 pF, L1=0.007506 nH, L2=1.255 nH, K=0.02913, and the center frequency is 60 GHz.

As compared with FIGS. 3A and 3B, it can be seen that the number of attenuation poles is increased to four because of the effect of capacitor 16. Therefore the attenuation amount for example at 53–56 GHz is largely increased.

Figure 7A:
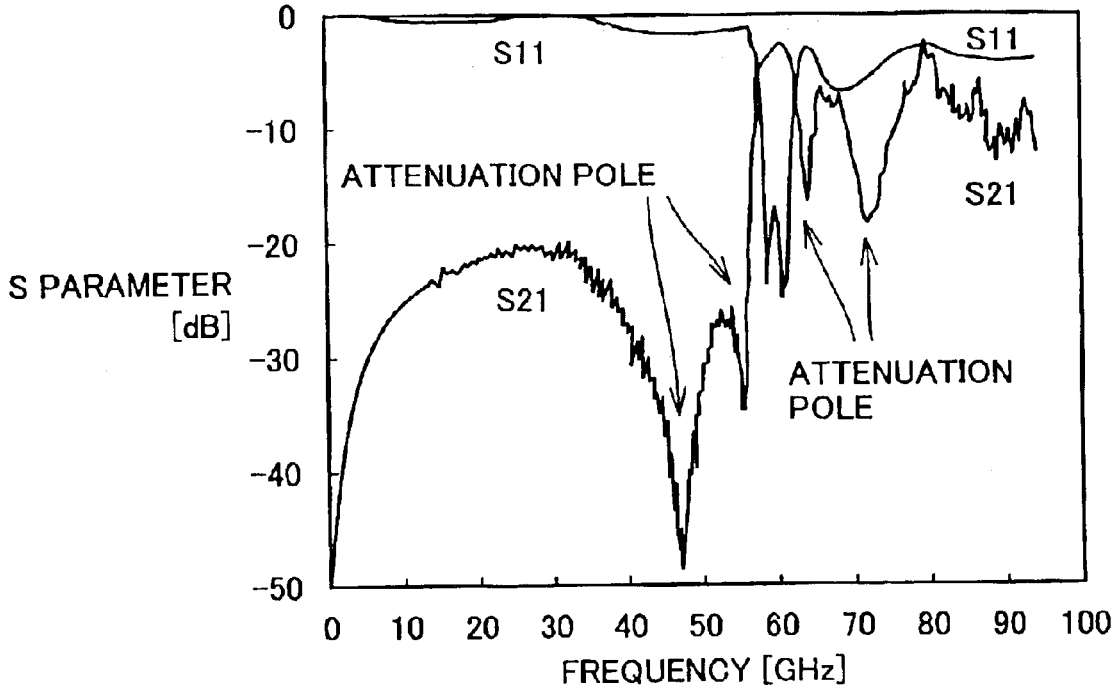
FIGS. 7A and 7B are graphs showing the filter characteristics of the prototype filter shown in FIG. 4.
Figure 7B:
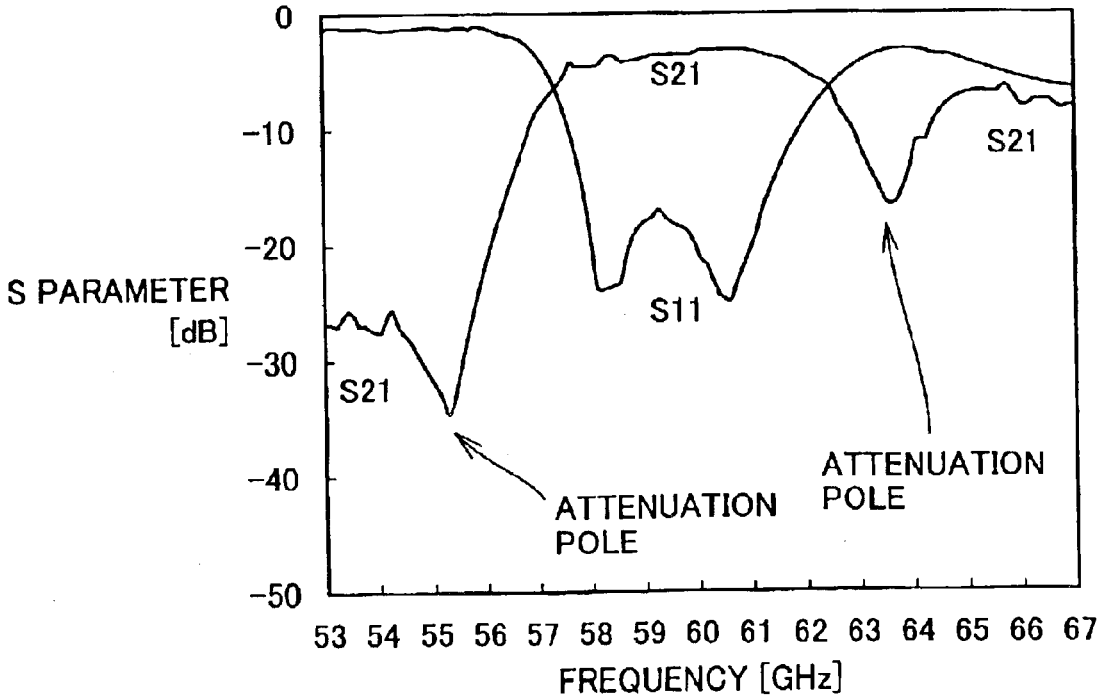

A filter having the structure shown in FIG. 4 was actually prototyped and determined and the result is shown in FIGS. 7A and 7B. This prototype filter was used as an RF filter of a radio communication circuit having a passband of 58–61 GHz and a local frequency of 57 GHz, and was designed specifically for suppressing an image frequency. Therefore two attenuation poles are certainly created at the frequencies above and below the passband, the lower frequency side of which are specially emphasized and designed.

FIG. 7A shows the filter characteristics in the wider band and FIG. 7B is a graph with the enlarged filter characteristics in the vicinity of the passband. As can be seen from FIG. 7A, the total four attenuation poles are formed at the frequencies immediately above and below the passband so that the steepness at the lower frequency side is largely increased. According to the measurement result, the insertion loss of the passband is −4.0 to −2.6 dB, the return loss of the passband is at least 17 dB, and the attenuation amount at the image frequency band of 53–56 GHz is at least 20.0 dB, resulting in practical performance.

This prototype filter was formed by patterning on an alumina ceramic substrate having a thickness of 0.15 mm mainly with a copper material. As a design rule of a fine pattern, a so-called line-and-space is 50 μm. In the portion other than the filter, the line width of the microstrip line is 150 μm, and in the filter portion, the line width for all lines including λ/2 open line resonators 8 and 9 is 50 μm. Each length of λ/2 open line resonators 8 and 9 is about 710 μm. In a feeder line, the total distance branching from the micro-strip line having a line width of 150 μm to the open end of line 6, 7 is about 650 μm. The gap distance between feeder line 6, 7 and λ/2 open line resonator 8, 9 is 50 μm, and the gap distance between two λ/2 open line resonators 8 and 9 is 90 μm.

It is noted that the specific value of the size shown herein may vary easily with the substrate thickness, dielectric constant ε of the substrate material, and the design rule of the line-and-space of the fine patterning, and therefore it is not absolute. In measurement, a network analyzer and a wafer probe for millimeter waves were used. These measuring instruments were calibrated using an LRM calibration substrate and an LRM calibration program fabricated by the manufacture thereof. The wafer probe was fixed to a wafer probe station not to cause any change in a contact state such as a position shift during measurement.

Third Embodiment

In the present invention, the number of λ/2 open line resonators is not limited to two. In order to design a wideband filter, the number of poles of resonance within the passband has to be increased and therefore the number of λ/2 open line resonators has to be increased. The present invention may be applied to such a case.

Figure 8:
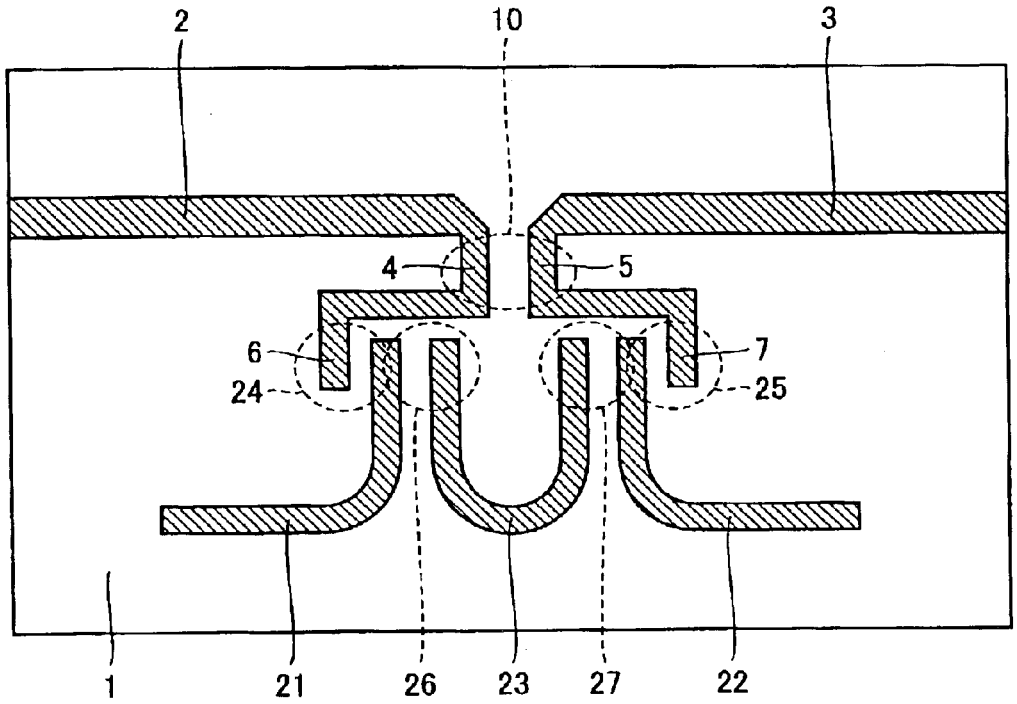
FIG. 8 is a plan view showing a configuration of a distributed constant filter in accordance with a third embodiment of the present invention.

FIG. 8 is a view showing a configuration of a distributed constant filter in accordance with a third embodiment of the present invention. Referring to FIG. 8, this filter differs from the filter in FIG. 1 in that lines 8 and 9 are replaced with lines 21–23.

Lines 21 and 22 are both formed in L-shape and have their one sides arranged in a direction orthogonal to lines 2 and 3, respectively, and their other sides arranged parallel to lines 2 and 3, respectively. The one side end portions of lines 22 and 23 are arranged parallel to the other side end portions of lines 6 and 7, respectively, at a distance of about λ/4 or less.

Line 23 is formed in U-shape and arranged between lines 21 and 22. The one side end portion of line 23 is arranged parallel to the one side end portion of line 21 at a distance of about λ/4 or less. The other side end portion of line 23 is arranged parallel to the one side end portion of line 22 at a distance of about λ/4 or less.

The one side end portion of line 21 and the other side end portion of line 6 form an electromagnetic field coupling portion 24. The one side end portion of line 22 and the other side end portion of line 7 form an electromagnetic field coupling portion 25. The one side end portion of line 23 and the other side end portion of line 21 form an electromagnetic field coupling portion 26. The other side end portion of line 23 and the other side end portion of line 22 form an electromagnetic field coupling portion 27. Each of lines 21–23 forms a λ/2 open line resonator.

In this way, in the present invention, the λ/2 open line resonator is not limited to have U-shape. Furthermore, in the present invention, the open end of the λ/2 open line resonator does not necessarily involve the electromagnetic field coupling, and it may be isolated without the electromagnetic field coupling.

Figure 9A:
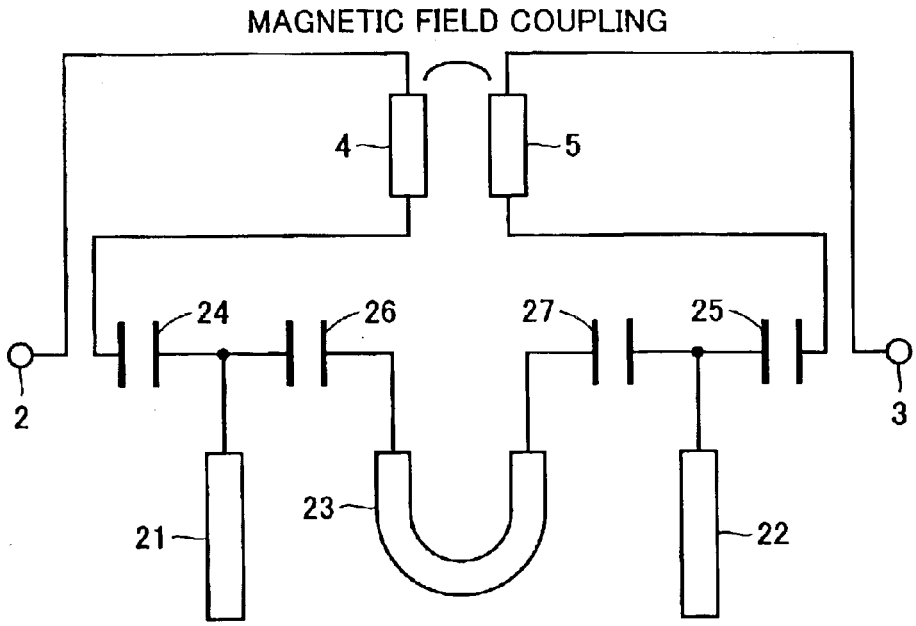
FIGS. 9A and 9B are circuit diagrams showing equivalent circuits of the filter shown in FIG. 8.
Figure 9B:
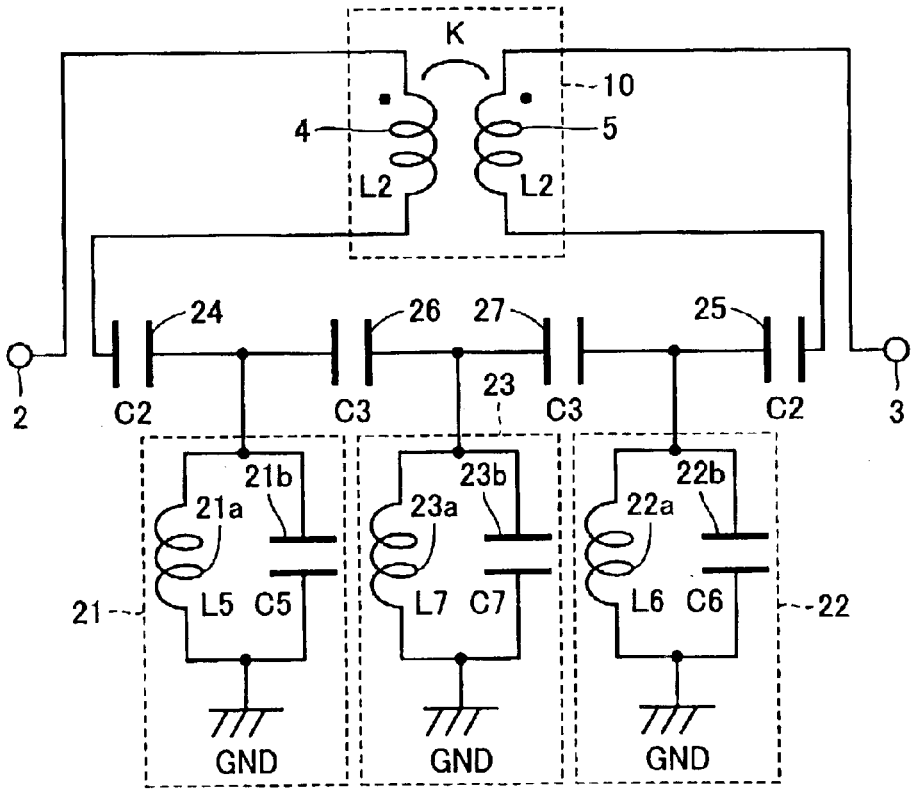

FIGS. 9A and 9B are circuit diagrams of equivalent circuits of the filter shown in FIG. 8. FIG. 9A is a circuit diagram with great use of distributed constant line and FIG. 9B is a circuit diagram with only concentrated constant.

In FIGS. 9A and 9B, the λ/2 open line resonator formed of line 21 is equivalent to an LC parallel resonance circuit including a coil 21*a* and a capacitor 21*b*. The λ/2 open line resonator formed of line 22 is equivalent to an LC parallel resonance circuit including a coil 22*a* and a capacitor 22*b*. The λ/2 open line resonator formed of line 23 is equivalent to an LC parallel resonance circuit including a coil 23*a* and a capacitor 23*b*.

Coils 21*a*–23*a* have the respective prescribed inductance L5–L7 and have their respective one electrodes grounded. Capacitors 21*b*–23*b* have the respective prescribed capacitance C5–C7 and have their respective one electrode grounded. Electromagnetic field coupling portions 24–27 are equivalent to capacitors having the respective prescribed capacitance C2, C2, C3, C3.

From the foregoing, in this equivalent circuit of the filter, the one electrodes of coil 21*a* and capacitor 21*b* of LC parallel resonance circuit 21 are grounded, and the other electrodes of coil 21*a* and capacitor 21*b* are connected to input terminal 2 through a capacitor 24 and coil 4. The one electrodes of coil 22*a* and capacitor 22*b* of LC resonance circuit 22 are grounded, and the other electrodes of coil 22*a* and capacitor 22*b* are connected to output terminal 3 through a capacitor 25 and coil 5.

The one electrodes of coil 23*a* and capacitor 23*b* of LC parallel resonance circuit 23 are grounded and the other electrodes of coil 23*a* and capacitor 23*b* are connected to a node between capacitor 24 and LC parallel resonance circuit 21 through capacitor 26 and also connected to a node between capacitor 25 and LC parallel resonance circuit 22 through capacitor 27. Coils 4 and 5 are brought into mutual inductive magnetic field coupling.

In the third embodiment, three λ/2 open line resonators 21–23 are provided so that a filter with a band wider than that in the first and second embodiments can be created.

Fourth Embodiment

Figure 10A:
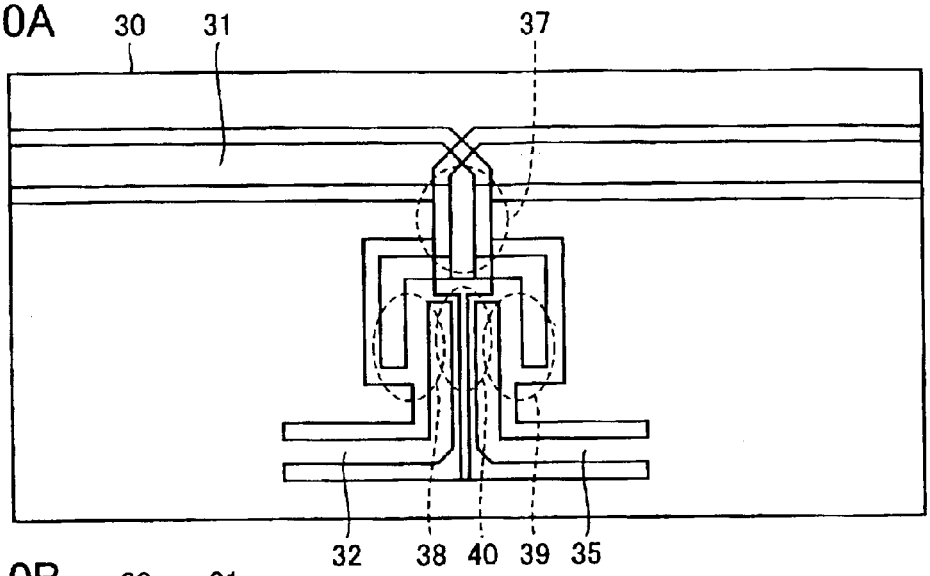
FIGS. 10A–10C are views showing a configuration of a distributed constant filter in accordance with a fourth embodiment of the present invention.
Figure 10B:
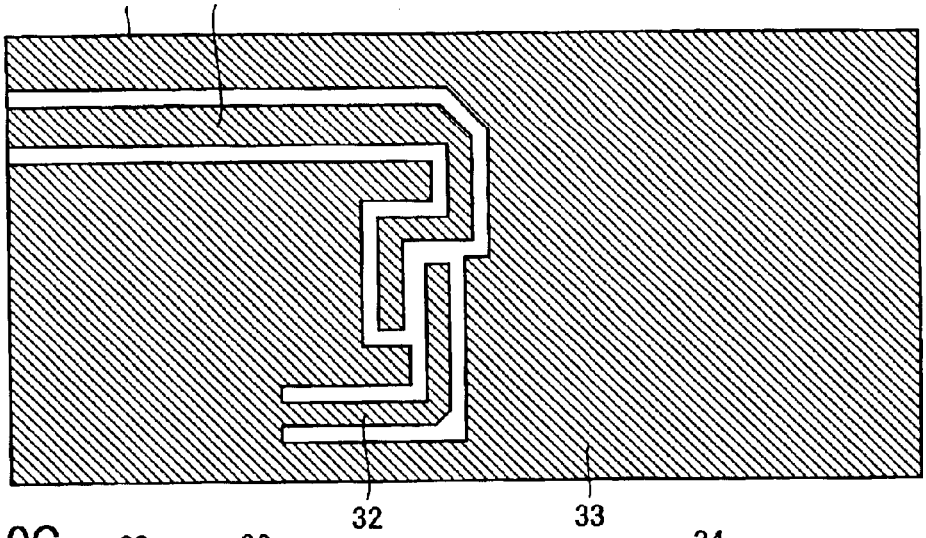
Figure 10C:
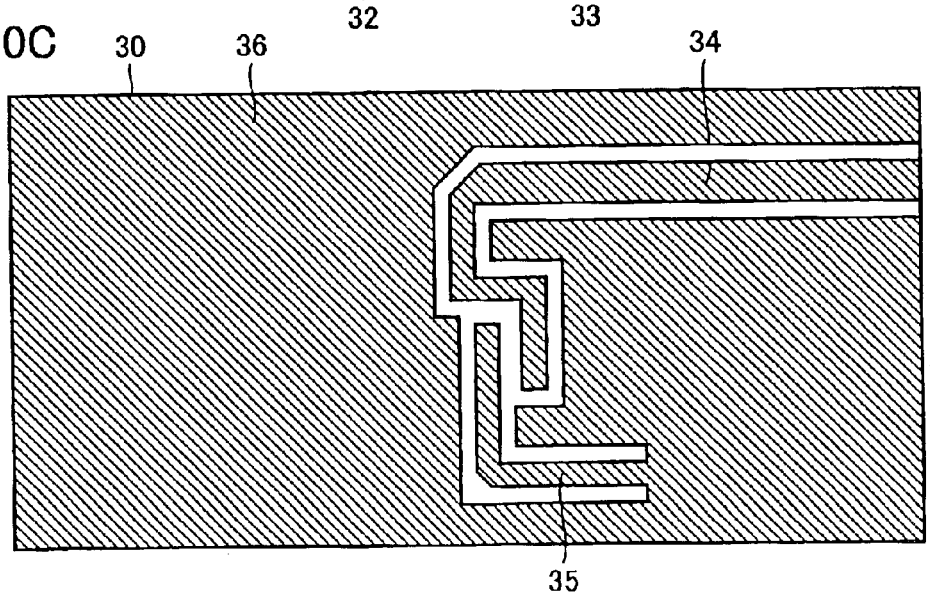

FIGS. 10A–10C are view showing a configuration of a filter in accordance with a fourth embodiment of the present invention. This filter includes an insulator substrate 30 and a line pattern formed on opposite surfaces thereof. FIG. 10A is a perspective view on the whole, FIG. 10B shows the pattern on the front surface of the substrate, and FIG. 10C shows the pattern on the back surface of the substrate. This filter is not a filter provided for a micro-strip line but a filter provided for a coplanar line.

In FIG. 10B, provided on the front surface of substrate 30 are a line 31 corresponding to lines 2, 4 and 6 in FIGS. 2A and 2B, a line 32 in L-shape, and a ground layer 33 formed to surround lines 31 and 32. The tip portion of line 31 and the one end portion of line 32 are arranged parallel in proximity. The other end portion of line 32 is connected to ground layer 33.

In FIG. 10C, provided on the back surface of substrate 30 are a line 34 corresponding to lines 3, 5 and 7 in FIGS. 2A and 2B, a line 35 in L-shape, and a ground layer 36 formed to surround lines 34 and 35. The tip portion of line 34 and the one end portion of line 35 are arranged parallel in proximity. The other end portion of line 35 is connected to ground layer 36.

In FIG. 10A, those parts of lines 31 and 34 which correspond to lines 4 and 5 in FIG. 1 are arranged in such a manner that they are overlapped above and below, to form an electromagnetic field coupling portion 37. The tip portions of lines 31 and 34 and the one end portions of lines 32 and 35 form electromagnetic field coupling portions 38 and 39, respectively. The one end portion of line 32 and the one end portion of line 35 form an electromagnetic field coupling portion 40. Each of lines 38 and 39 forms a λ/4 short-circuited line resonator.

The equivalent circuits of this filter are same as the equivalent circuits in FIGS. 2A and 2B. The λ/4 short-circuited line resonators 32 and 35 form LC parallel resonance circuits 8 and 9, respectively. Electromagnetic field coupling portions 38) 39 and 40 form capacitors 11, 12 and 13, respectively. Electromagnetic field coupling portion 37 forms coils 4 and 5 in mutual inductive magnetic filed coupling.

In the fourth embodiment, the coupling between front and back patterns of monolayer substrate 30 was used to obtain a strong mutual inductive magnetic field coupling. To obtain a strong mutual inductive magnetic field coupling, the interlayer coupling with upper and lower patterns on different layers in two or more multi-layer substrate may be used other than this method.

Fifth Embodiment

Figure 11A:
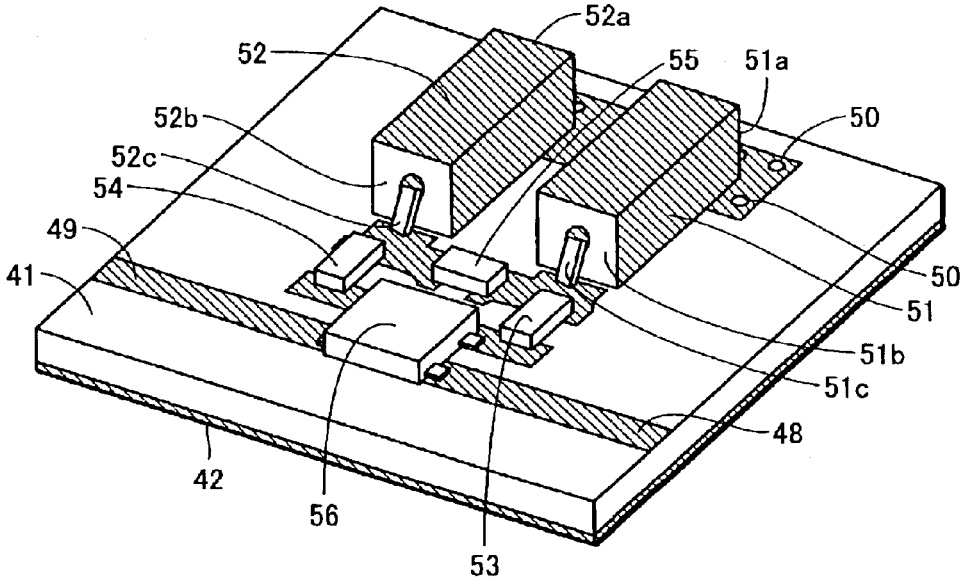
FIGS. 11A and 11B are views showing a configuration of a filter in accordance with a fifth embodiment of the present invention.
Figure 11B:
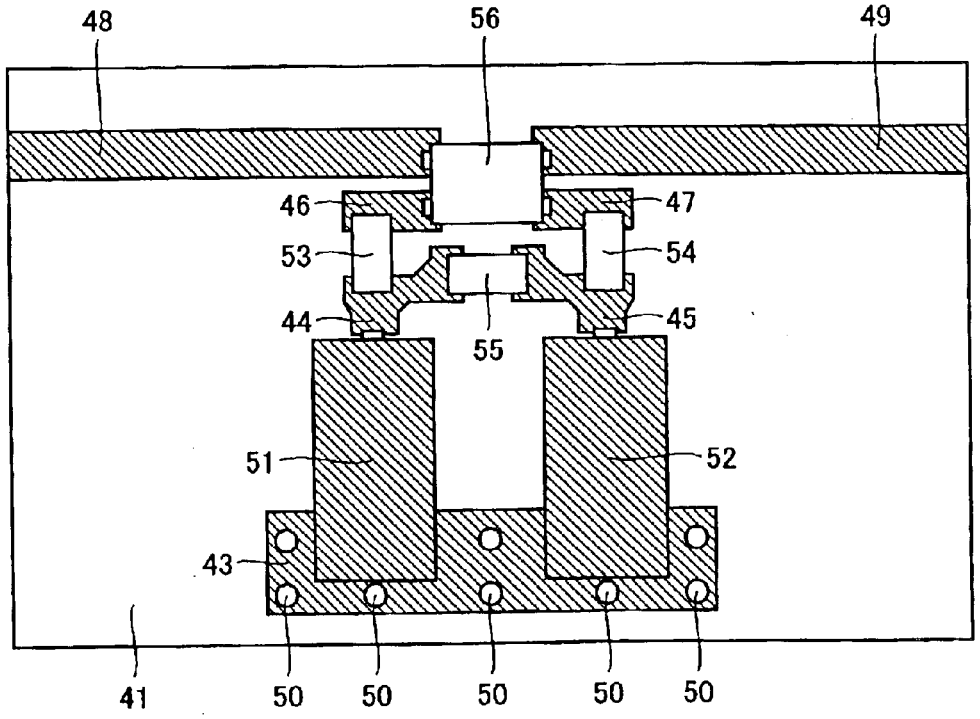

FIGS. 11A and 11B are views showing a configuration of a filter in accordance with a fifth embodiment of the present invention. This filter is implemented with the circuit diagram in FIG. 2 in a form suitable for the semi-microwave band. FIG. 11A is a perspective view of the filter, and FIG. 11B is a plan view of the filter seen from above.

Referring to FIGS. 11A and 11B, this filter is formed of an insulator substrate 41 and a plurality of discrete components. A ground electrode 42 is formed on the entire back surface of substrate 41 and electrodes 43–49 are formed on the front surface of substrate 41. Electrode 43 is connected to ground electrode 42 through a plurality of via holes 50.

In this filter, LC parallel resonance circuits 8 and 9 in FIGS. 2A and 2B are implemented by so-called dielectric resonators 51 and 52. Dielectric resonator 51, 52 is a known technique that has already been utilized in the semi-microwave band, and has a coaxial structure in which an insulator such as alumina ceramic is sandwiched between an outer conductor and a center conductor. The length of dielectric resonator 51, 52 is designed to the length of $\lambda/4$ relative to the wavelength $\lambda$ around the center frequency of the filter, each of one ends 51*a* and 51*b* is connected to electrode 43 with the outer conductor and the center conductor being short-circuited and each of the other ends 51*b* and 52*b* is open-ended. On the side of open ends 51*b* and 52*b,* the center conductors of resonators 51 and 52 are connected to electrodes 44 and 45 on substrate 41 through lead pins 51*c* and 52*c,* respectively.

Figure 12:
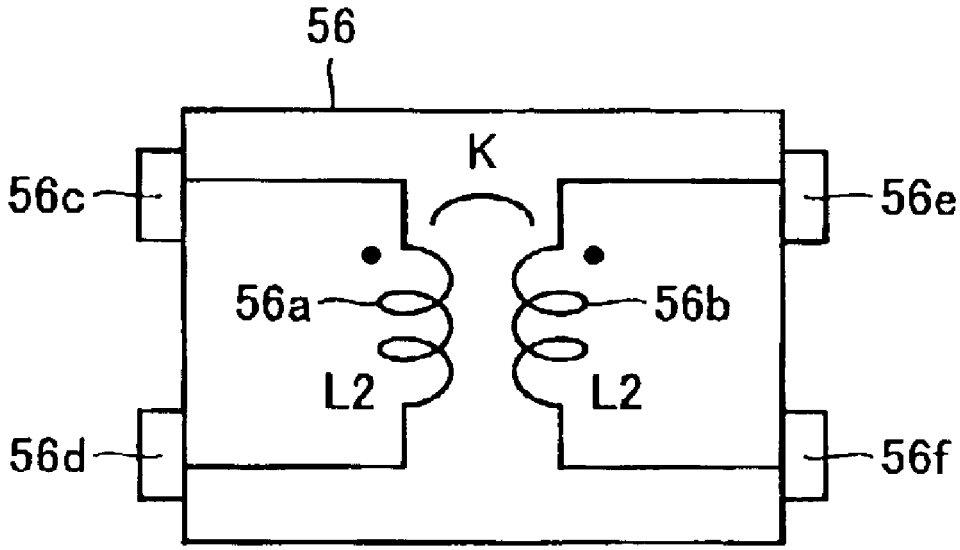
FIG. 12 is a circuit diagram showing a configuration of a transformer shown in FIGS. 11A and 11B.

Capacitors 11–13 in FIGS. 2A and 2B are implemented by chip capacitors 53–55, respectively, in the fifth embodiment. Chip capacitors 53–55 are connected respectively between electrodes 44 and 46, 45 and 47, 44 and 45. Furthermore, electromagnetic field coupling portion 10 in FIGS. 2A and 2B is implemented by a transformer 56 as a discrete component in this filter. Transformer 56 includes terminals 56*c*–56*f*, a coil 56*a* connected between terminals 56*c* and 56*d*, and a coil 56*b* connected between terminals 56*e* and 56*f* as shown in FIG. 12. Coils 56*a* and 56*b* are brought into the mutual inductive magnetic field coupling. Terminals 56*c*–56*f* are respectively connected to electrodes 48, 46, 49, and 47. Electrodes 48 and 49 form input terminal 2 and output terminal 3.

In this way, the present invention is not limited to the distributed constant circuit for the millimeter wave band and can be implemented with a circuit with a lower frequency using a discrete component.

It is noted that the present invention can easily be applied not only to one dual-terminal filter circuit but to a triple-terminal duplexer-type filter circuit or a multiplexer type filter circuit having three or more terminals.

Sixth Embodiment

In a sixth embodiment, an exemplary application of the filter in the first to fifth embodiments will be described. In the sixth embodiment, the millimeter wave in the 60 GHz band is used as indoor radio transmission wave. The millimeter wave in the 60 GHz band has a frequency significantly higher than the present satellite TV broadcast wave and provides a wide radio bandwidth for a transceiver, so that ground broadcast and satellite broadcast can collectively be transmitted wirelessly. In addition, in this frequency band, the absorption by oxygen and moisture is great and therefore the blocking between adjacent houses is easy. Furthermore, in this frequency, ½ wavelength is 2.5 mm in the air, which is equivalent to the chip size of IC, so that the antenna can be integrated with IC. This reduces the equipment in size, and light and small radio modules can be built into electronic equipment. Therefore this frequency band is suitable for indoor radio transmission at home.

Figure 13:
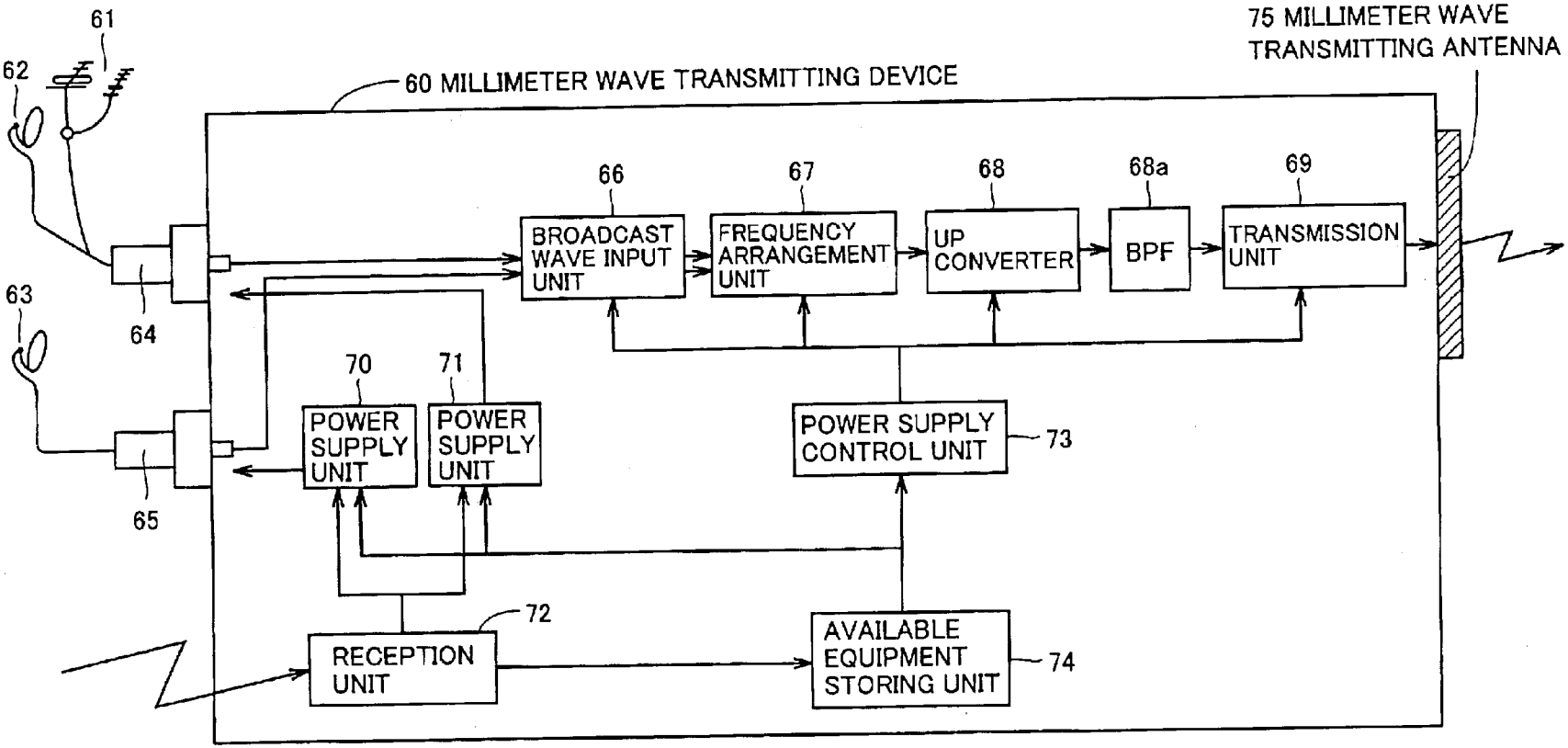
FIG. 13 is a block diagram showing a configuration of a millimeter wave transmitting device included in a high frequency radio communication device in accordance with a sixth embodiment of the present invention.
Figure 14B:
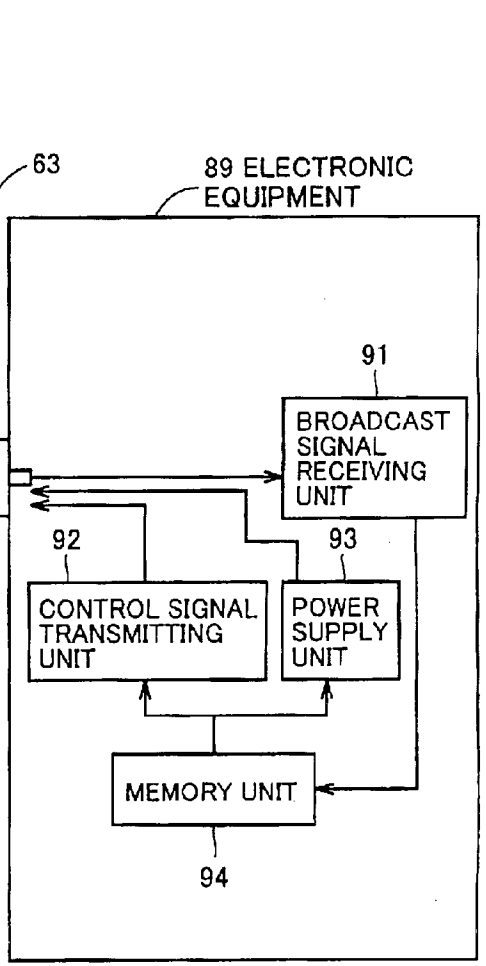
FIGS. 14A and 14B are block diagrams showing a configuration of a millimeter wave receiving device and electronic equipment included in the high frequency radio communication device illustrated in FIG. 13.
Figure 14A:
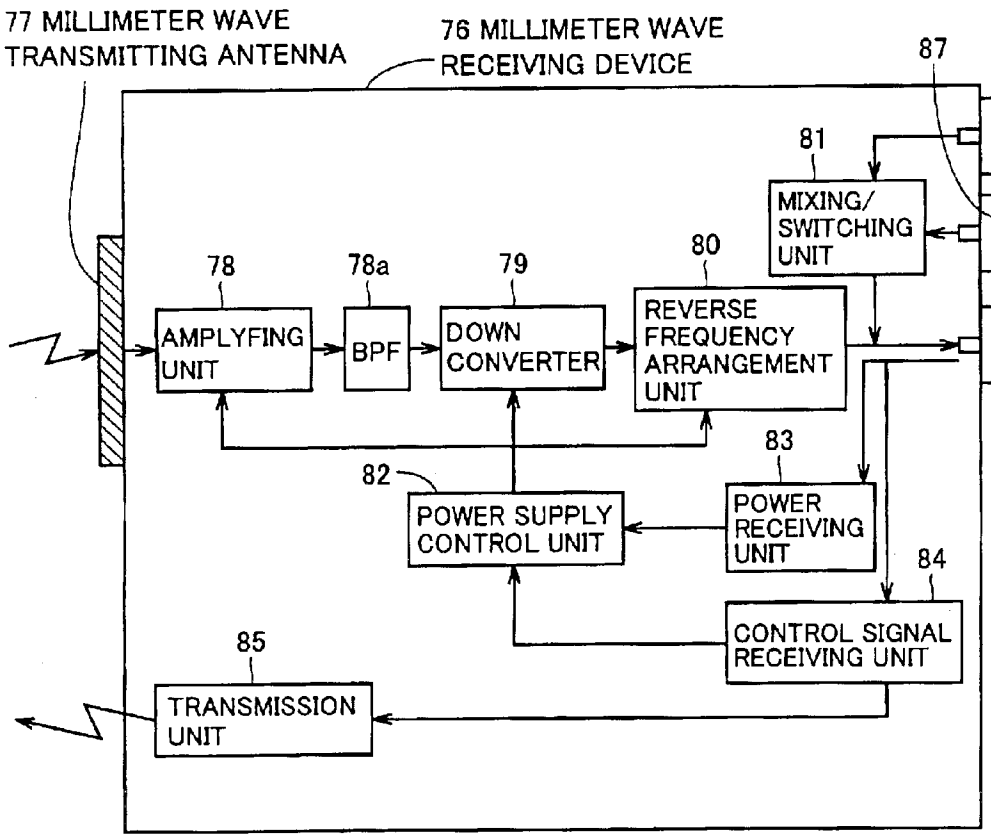

FIGS. 13, 14A and 14B are block diagrams showing the configuration of the high frequency radio communication device in accordance with the sixth embodiment of the present invention. In FIGS. 13, 14A and 14B, this high frequency radio communication device includes a millimeter wave transmitting device 60, a millimeter wave receiving device 76, and electronic equipment 89. Millimeter wave transmitting device 60 includes a VHF/UHF antenna 61, a BS antenna 62, a CS antenna 63, a connector 64, a connector 65, a broadcast wave input unit 66, a frequency arrangement unit 67, an up-converter 68, a bandpass filter (BPF) 68*a*, a transmission unit 69, a power supply unit 70, a power supply unit 71, a reception unit 72, a power supply control unit 73, an available device storage unit 74, and a millimeter wave transmitting antenna 75. Millimeter wave receiving device 76 includes a millimeter wave receiving antenna 77, an amplifying unit 78, a bandpass filter 78*a*, a down-converter 79, a reverse frequency arrangement unit 80, a mixing/switching unit 81, a power supply control unit 82, a power receiving unit 83, a control signal receiving unit 84, transmission unit 85, an antenna terminal 86, an antenna terminal 87, and a connector 88. Electronic equipment 89 includes an antenna terminal 90, a broadcast signal receiving unit 91, a control signal transmitting unit 92, a power supply unit 93, and a memory unit 94.

If electronic equipment 89 is for example a TV receiver, a display unit or the like is provided other than the configuration described above, although not shown in FIGS. 14A and 14B.

First, that part which is related to the basic millimeter wave transmission in millimeter wave transmitting unit 60 and millimeter wave receiving unit 76 will be described.

Radio waves from ground broadcast or satellite broadcast are input to connectors 64 and 65 through VHF/UHF antenna 61, BS antenna 62 or CS antenna 63. Although two connectors 64 and 65 are shown here, the present invention is not limited thereto and any number of connectors can be provided depending on the connection situation. Furthermore, although antennas are connected here, a supply terminal for collective broadcast waves from a community receiving system such as CATV may be connected. The broadcast wave input from connectors 64 and 65 is supplied to broadcast wave input unit 66. Broadcast wave input unit 66 is usually formed of an amplifier having its gain set appropriately depending on the frequency band, the modulation format and the like, and the amplified broadcast wave is supplied to frequency arrangement unit 67.

Figure 15:
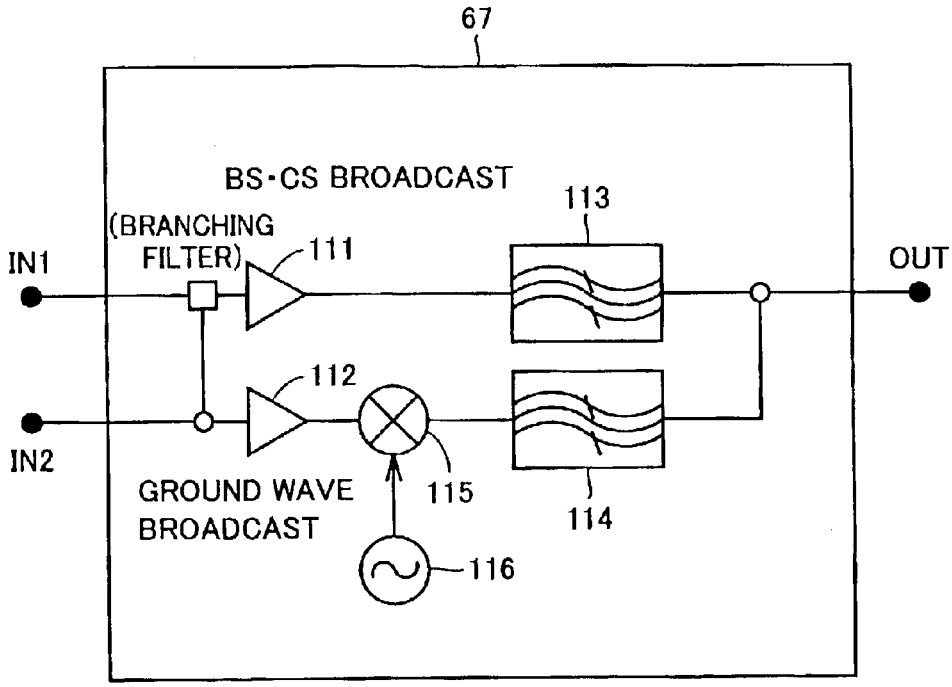
FIG. 15 is a block diagram showing a configuration of a frequency arrangement unit shown in FIG. 13.

Frequency arrangement unit 67 includes amplifiers 111 and 112, filters 113 and 114, a frequency mixer 115, and a local oscillator 116, as shown in FIG. 15. Amplifier 111 amplifies BS and CS broadcast signals. Filter 113 removes unnecessary frequency components from the output signal from amplifier 111. Amplifier 112 amplifies a ground wave broadcast signal Frequency mixer 115 and local oscillator 116 convert the frequency of the output signal from amplifier 112. Filter 114 removes unnecessary signal components from the frequency-converted signal.

Figure 17A:
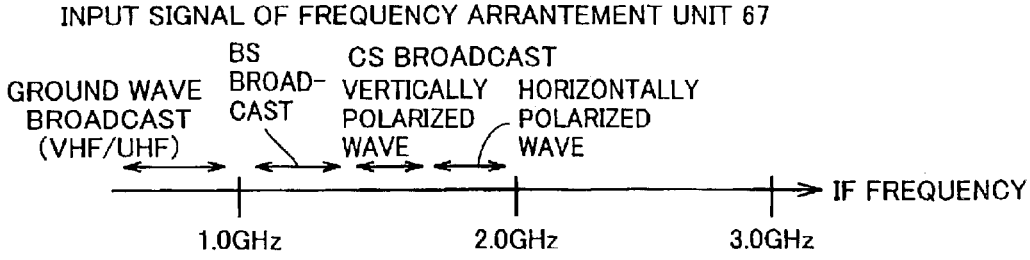
FIGS. 17A–17D are diagrams illustrating the operation of the high frequency communication device shown in FIGS. 13–16.
Figure 17B:
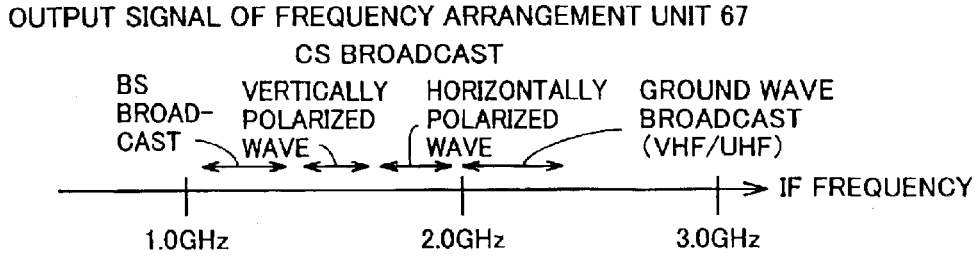

The CS and BS intermediate frequency in the signal input to frequency arrangement unit 67 is arranged on a frequency axis of intermediate frequency 1035 MHz–1895 MHz, as shown in FIG. 17A, by a block converter (not shown) provided between connector 65 and CS antenna 63 in a case of the community reception. Only the ground wave broadcast signal of such input signal is converted in frequency by frequency mixer 115 and local oscillator 116 in frequency arrangement unit 67 and is arranged on the side of the frequency higher than CS broadcast signal on the frequency axis, as shown in FIG. 17B. Since the frequency of the ground wave broadcast is lower, the signal that is up-converted to the 60 GHz band comes into the vicinity of the local oscillating wave. This local oscillating wave is essentially an unnecessary wave that has to be removed without being radiated from the antenna. Therefore if the ground wave broadcast is up-converted as it is, it is removed along with the local oscillating wave. Consequently, the ground broadcast wave is converted in frequency to the other frequency band (for example 2 GHz band) at the intermediate frequency stage in frequency arrangement unit 67.

Figure 17C:
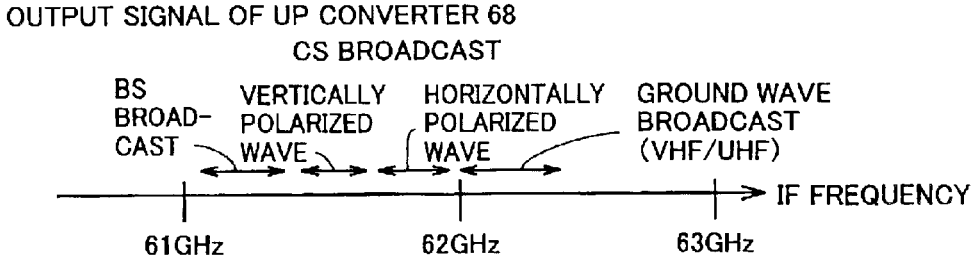

The broadcast wave arranged on the frequency axis in this way is up-converted to the 60 GHz band by up-converter 68 within millimeter wave transmitting device 60 with the unnecessary wave being removed by bandpass filter 68*a*, resulting in the radio frequency as shown in FIG. 17C, which is amplified in power in transmission unit 69 and is output as a millimeter wave radio signal from millimeter wave transmitting antenna 75 of millimeter wave transmitting device 60.

On the other hand, the millimeter wave radio signal received at millimeter receiving antenna 77 of millimeter wave receiving device 76 is amplified by amplifying unit 78 with the image signal being removed by bandpass filter 78*a*, is thereafter down-converted by down-converter 79, and is input to reverse frequency arrangement unit 80. Bandpass filters 68*a* and 78*a* are formed of the filters described in the first to fifth embodiments.

Figure 16:
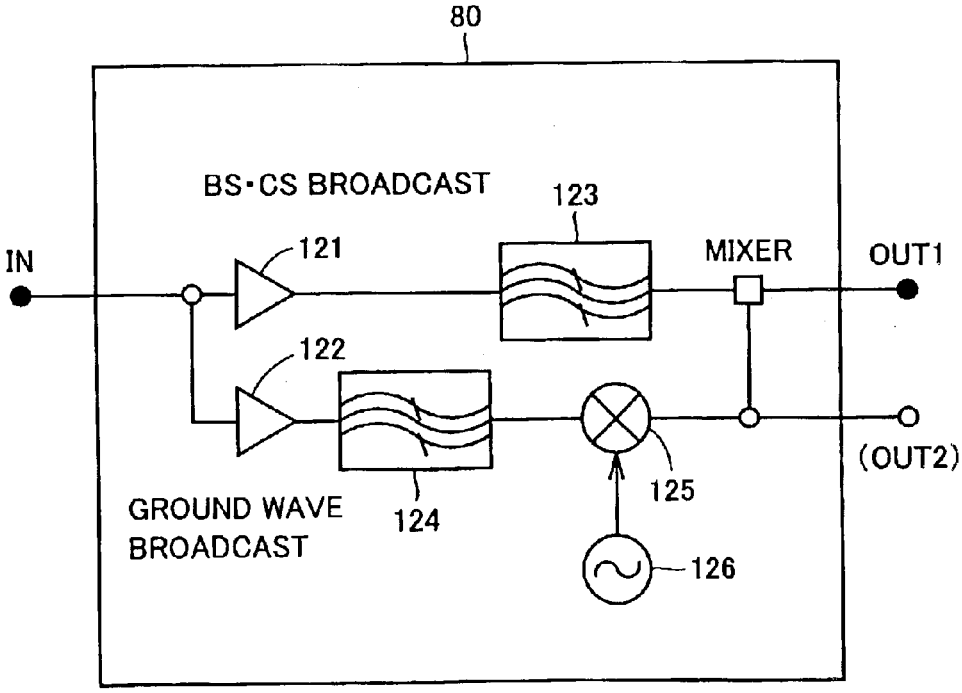
FIG. 16 is a block diagram showing a configuration of a reverse frequency arrangement unit shown in FIGS. 14A and 14B.

Reverse frequency arrangement unit 80 includes amplifiers 121 and 122, filters 123 and 124, frequency mixer 125, and local oscillator 126, as shown in FIG. 16. Amplifier 121 amplifies the reproduced BS and CS broadcast signals. Filter 123 removes unnecessary frequency components from the output signal from amplifier 121. Amplifier 124 amplifies the reproduced ground wave broadcast signal. Filter 124 removes unnecessary frequency components from the output signal of amplifier 122. Frequency mixer 125 and local oscillator 126 converts the frequency of the signal that is passed through filter 124.

Figure 17D:
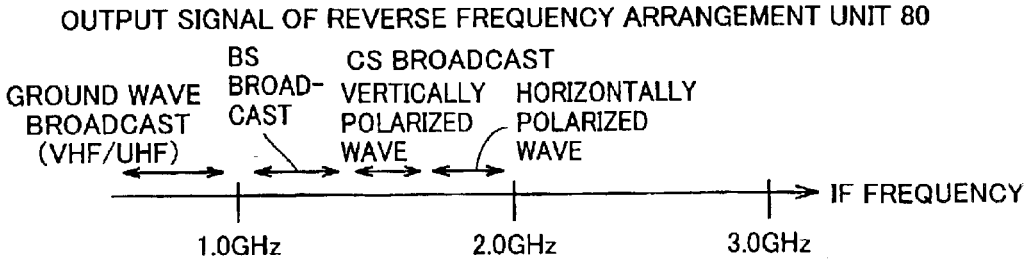
Figure 18:
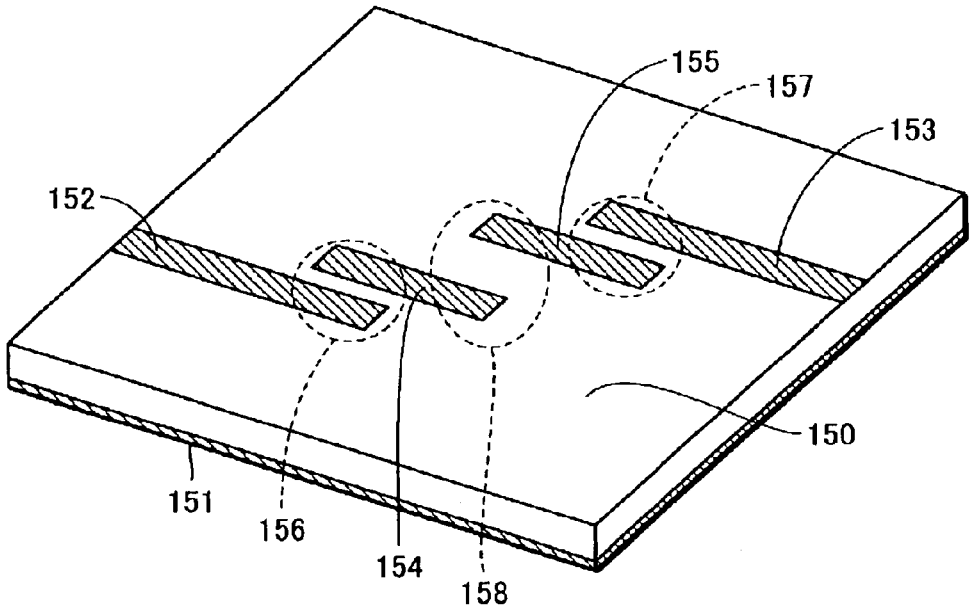
FIG.18 PRIOR ART
FIG. 18 is a perspective view showing a configuration of a conventional distributed constant filter.
Figure 19A:
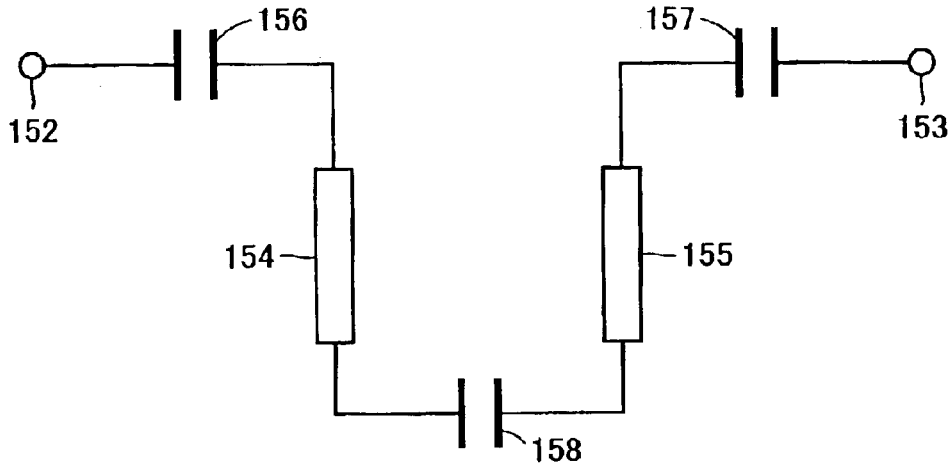
FIG.19A PRIOR ART
FIGS. 19A and 19B are circuit diagrams showing equivalent circuits of the filter shown in FIG. 18.
Figure 19B:
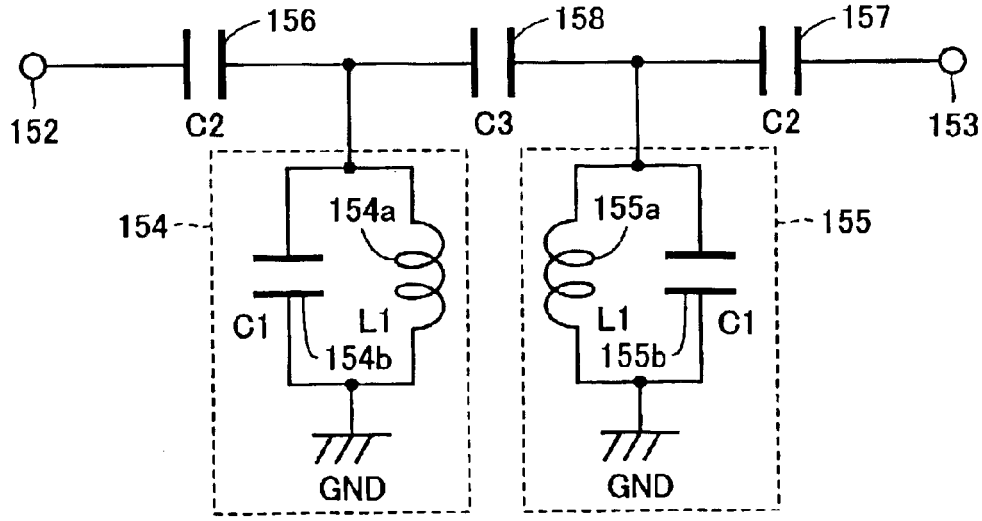
FIG.19B PRIOR ART

Reverse frequency arrangement unit 80, as shown in FIG. 17D, has a function of converting the frequency from the intermediate frequency on the frequency axis to the original ground wave frequency using frequency mixer 125 and local oscillator 126 through a process that is the reverse of frequency arrangement unit 67. The resulting broadcast wave is input to electronic equipment 89, which is in turn ready for TV reception if it is a TV receiver.

The foregoing is the basic configuration for transmitting in millimeter waves the broadcast waves collectively to electronic equipment 89 such as a TV receiver through millimeter wave transmitting unit 60 and millimeter wave receiving device 76.

Next, a configuration for controlling millimeter wave receiving device 76 and millimeter wave transmitting device 60 from electronic equipment 89 will be described.

Electronic equipment 89 such as a TV receiver uses broadcast signal receiving unit 91 to select and receive the broadcast wave supplied from antenna terminal 90. In the conventional receiving system that does not use millimeter wave receiving device 76, VHF/UHF antenna 61, BS antenna 62 or CS antenna 63 is directly connected to antenna terminal 90. When millimeter wave receiving device 76 is used, antenna terminal 90 is connected to connector 88.

Millimeter wave receiving device 76 is provided with mixing/switching unit 81 and antenna terminals 86 and 87. Therefore when millimeter wave receiving device 76 is attached to electronic equipment 89, VHF/UHF antenna 61, BS antenna 62 or CS antenna 63 is also connected directly to antenna 86 or 87 to allow the broadcast waves therefrom to be used through mixing/switching unit 81. When millimeter wave receiving device 76 is used, antenna terminals 86 and 87 usually need not be connected. However, in cases where transmission from millimeter wave transmitting device 60 is specific to VHF, UHF and BS broadcast, for example, and CS broadcast desirably uses a different system by wiring through a coaxial cable, or where the operation of millimeter wave transmitting device 60 or millimeter wave receiving device 76 should be stopped, VHF/UHF antenna 61, BS antenna 62, CS antenna 63 and the like can be connected without any change to the connection where millimeter wave receiving device 76 is connected to electronic equipment 89.

When the user selects the desired channel to receive using broadcast signal receiving unit 91 in electronic equipment 89, the user stores beforehand whether the received channels are the direct inputs from VHF/UHF antenna 61, BS antenna 62, CS antenna 63 and the like, or the inputs through millimeter wave transmitting device 60 and millimeter wave receiving device 76 in association with the received channels, in memory unit 94. Based on the information stored in memory unit 94, if the selected received channel is the one to use millimeter wave transmitting device 60 and millimeter wave receiving device 76, the power supply necessary for the operation of millimeter wave receiving device 76 is fed by power supply unit 93 through antenna terminal 95. The power is supplied with the broadcast wave superposed thereon.

Alternatively, the power may be supplied by power supply unit 93 when electronic equipment 89 is turned on, and the power supply control of power supply control unit 82 may be performed as necessary with the superposed control signal from control signal transmitting unit 92.

In this case, the power supply and the control signal passed through connector 88 are supplied through power receiving unit 83 and control signal receiving unit 84 to power supply control unit 82 respectively separate from the broadcast wave. Usually, the power consumption is suitably reduced if the power is supplied from power supply unit 93 when electronic equipment 89 requires a reception operation. Although power supply control unit 82 controls the power supply to amplifying unit 78, down-converter 79 and reverse frequency arrangement unit 80, it may control the other block that requires the power supply control. Although the power can be supplied from electronic equipment through connector 88 herein, a power supply adapter for millimeter wave receiving device 76 in addition to electronic equipment 89 may be used or millimeter wave receiving device 76 itself may include a power supply circuit that receives power supply from AC power supply, as electronic equipment 89 does not always support power supply to millimeter wave receiving device 76.

Furthermore, if electronic equipment 89 is a CS tuner capable of receiving CS broadcast or a TV receiver, control signal transmitting unit 92 can transmit information that specifies vertically polarized waves or horizontally polarized waves to be used depending on the received channel to CS antenna 63, in addition to the control of the power supply. In the case of BS broadcast reception, it transmits information about whether power is supplied to BS antenna 62. The information about vertically polarized waves or horizontally polarized waves, or BS reception and the like is created by control signal receiving unit 92, is transmitted through antenna terminal 90 and connector 88, and is separated by control signal receiving unit 84. The separated information is transmitted by transmission unit 85 to millimeter wave transmitting unit 60. Although signal is usually transmitted from transmission unit 85 to reception unit 72 using infrared radiation, the present invention is not limited to infrared and may use radio wave, wire, voice, power-line carrier and the like.

If the radio waves in UHF band are used in particular, it can transmit through shields such as screens and walls, unlike infrared communication, to allow the millimeter wave transmitting device and the millimeter wave receiving device to be used for divided rooms. Furthermore, by incorporating a cordless phone such as a PHS, data transmission can be realized, in addition to a signal for horizontal and vertical polarization control, to allow for two-way communications.

When electronic equipment 89 is turned off and does not require reception, as described above, the power supply is cut off to a circuit block that needs not operate, including amplifying unit 78, down-converter 79, reverse frequency arrangement unit 80 and the like in millimeter wave receiving device 76, and the power supply has to be controlled to a circuit block that needs not operate, including broadcast wave input unit 66, frequency arrangement unit 67, up-converter 68, transmission unit 69 and the like in the millimeter wave transmitting device 60. Assume the case where a transmission output from one millimeter wave transmitting device 60 is provided to a combination of a plurality of millimeter wave receiving devices 76 and electronic equipment 89, for example, where electronic equipment 89 is a large stationary TV receiver and a portable liquid crystal TV receiver which are provided with the respective millimeter wave receiving devices 76. Therefore in this case electronic equipment 89 as a large stationary TV receiver and electronic equipment 89 as a portable liquid crystal TV receiver respectively transmit equipment identification information and information indicating that that equipment now requires reception, for example, information indicative of ON to millimeter wave receiving devices 76 that are respectively connected thereto, using control signal transmitting unit 92. The transmitted information is separated by control signal receiving unit 84 and transmitted to one millimeter wave transmitting device 60 by transmission unit 85.

Millimeter wave transmitting device 60 receives this information at reception unit 72 and transmits it to available equipment storing unit 74. Available equipment storing unit 74 allows the user to store the equipment that uses the broadcast wave of millimeter wave transmitting device 60 in advance, and obtains the equipment identification information and the information indicating that that equipment now requires reception for pieces of equipment stored therein from reception unit 72. If all pieces of equipment stored in available equipment storing unit 74 are turned off and do not require the broadcast waves, power supply control unit 73 then cuts off the power supply to broadcast wave input unit 66, frequency arrangement unit 67, up-converter 68, transmission unit 69, and the like, and also power supply units 70 and 71 cuts off the power supply to CS antenna 63, BS antenna 62 and the like. In this way, the power consumption can be reduced when millimeter wave transmitting device 60 and millimeter wave receiving device 76 are not required.

As described above, in accordance with the present invention, even in the high frequency band such as the millimeter wave band, a filter excellent in steepness can be realized with a low-cost planar print circuit. Moreover, the steepness is not high simply because of a narrow band filter. The steepness can be increased while for example 5% or more in the specific bandwidth can be ensured.

Furthermore, in a communication circuit for extremely high frequency such as millimeter wave band, the filter in accordance with the present invention may be used as an RF filter to remove local signals and image signals so that the device can advantageously be miniaturized, simplified and reduced in cost.

In a communication circuit for extremely high frequency such as millimeter wave band, conventionally, since a low loss filter with steepness is hardly realized with a planar circuit, a waveguide type filter or a filter having such a structure in that a charger resonator is enclosed in a metal case has been used as a filter circuit. Alternatively, a balance type MMIC mixer has been used to provide a mixer with a filter function. However, all of these techniques have problems in size or cost. In accordance with the present invention, however, since a simple planar circuit filter can be realized even in the extremely high frequency band such as the millimeter wave band, the device as a whole can be miniaturized in a casing structure and the like, be simplified, and be reduced in cost.

One of reasons the frequencies in the millimeter wave band have drawn attention in wireless communications is that they enable a super wideband transmission as using a bandwidth from a few hundred MHz to a few GHz. Japanese Patent Laying-Open No. 2000-353971, for example, has proposed a millimeter wave transmitting system for a few hundred channels of television image signals. In such a system, a bandwidth of 1–3 GHz is required. In a filter design, however, the bandwidth and the steepness are generally contradictory requirements. In the filter circuit in accordance with the present invention, however, as shown in FIGS. 7A and 7B, the bandwidth of 3 GHz or more and the high steepness can be realized at the same time. Furthermore, as shown in FIG. 8, the increased $\lambda/2$ open line resonators in number further facilitate the compatibility between the bandwidth and the high steepness. In view of these characteristics, the filter circuit in accordance with the present invention is effective particularly when it is used in a wideband radio system in the millimeter wave band. Furthermore, the filter circuit of the present invention is effectively employed to reduce the cost and size in the wideband system in the millimeter wave band as disclosed in Japanese Patent Laying-Open No. 2000-353971.

It should be understood that the embodiments disclosed herein are not by way of limitation but by way of illustration. It is intended that the scope of the present invention is set forth not in the foregoing description but in the claims and all equivalents and modifications within the claims are embraced.

What is claimed is:

1. A filter circuit selectively passing a predetermined frequency component of a signal input to an input terminal to an output terminal, comprising:

an electromagnetic field coupling circuit for connecting said input terminal and a first terminal, and connecting said output terminal and a second terminal, and bringing said input terminal and said output terminal into magnetic field coupling by mutual induction to each other;

at least three capacitors connected in series between said first and second terminals; and at least two resonators respectively connected to at least two nodes between said at least three capacitors, wherein said electromagnetic field coupling circuit is implemented by a transformer that includes a primary coil connected between said input terminal and said first terminal, and a secondary coil connected between said output terminal and said second terminal, and coupling said primary and secondary coils together so a portion of said primary coil and secondary coil are identical in polarity.

2. The filter circuit according to claim 1, wherein said filter circuit is formed of a line pattern made of a conductor formed on an insulator substrate;

said first and second terminals respectively include first and second lines;

said electromagnetic field coupling circuit includes a third line connected between said input terminal and one end portion of said first line and a fourth line connected between said output terminal and one end portion of said second line;

said third and fourth lines are arranged parallel to each other in proximity; and said at least two resonators respectively include at least two fifth lines having a predetermined line length, an other end portion of said first line and one fifth line, an other end portion of said second line and another fifth line, and two fifth lines are capacitive-coupled to each other to form said at least three capacitors.

3. The filter circuit according to claim 2, wherein said third and fourth lines are proximate to each other at a position of a quarter wave of a signal having a center frequency of said filter circuit from open ends of said first and second lines.

4. The filter circuit according to claim 1, wherein each of said at least two resonators is a quarter wave short-circuited line resonator or a half wave open line resonator.

5. The filter circuit according to claim 1, wherein said filter circuit is used as a part of a multiplexer type filter circuit.

6. The filter circuit according to claim 1, further comprising a high frequency communication circuit used as a high frequency filter for removing a local signal or an image signal.

7. A filter circuit selectively passing a predetermined frequency component of a signal input to an input terminal to an output terminal, comprising:

a first capacitor connected between said input terminal and said output terminal;

an electromagnetic field coupling circuit for connecting said input terminal and a first terminal, and connecting said output terminal and a second terminal, and bringing said input terminal and said output terminal into magnetic field coupling by mutual induction to each other;

at least three second capacitors connected in series between said first and second terminals; and at least two resonators respectively connected to at least two nodes between said at least three second capacitors, wherein said electromagnetic field coupling circuit is implemented by a transformer that includes a primary coil connected between said input terminal and said first terminal, and a secondary coil connected between said output terminal and said second terminal, and coupling said primary and secondary coils together so a portion of said primary coil and secondary coil are identical in polarity.

8. The filter circuit according to claim 7, wherein each of said at least two resonators is a quarter wave short-circuited line resonator or a half wave open line resonator.

9. The filter circuit according to claim 7, wherein said filter circuit is used as a part of a multiplexer type filter circuit.

10. The filter circuit according to claim 7, further comprising a high frequency communication circuit used as a high frequency filter for removing a local signal or an image signal.

11. The filter circuit according to claim 7, wherein said filter circuit is formed of a line pattern made of a conductor formed on an insulator substrate;

said input terminal and said output terminal respectively include first and second lines;

said first and second terminals respectively include third and fourth lines;

said electromagnetic field coupling circuit includes a fifth line connected between said first line and one end portion of said third line and a sixth line connected between said second line and one end portion of said fourth line;

said fifth and sixth lines are arranged parallel to each other in proximity;

said at least two resonators includes at least two seventh lines each having a predetermined line length;

said first and second lines are capacitive-coupled to each other to form said first capacitor, and an other end portion of said third line and one seventh line, an other end portion of said fourth line and another seventh line, and two seventh lines are capacitive-coupled respectively to each other to form said at least three second capacitors.

12. The filter circuit according to claim 11, wherein said fifth and sixth lines are proximate to each other at a position of a quarter wave of a signal having a center frequency of said filter circuit from open ends of said third and fourth lines.

* * * * *